US009822995B2

(12) United States Patent
Wakamoto et al.

(10) Patent No.: US 9,822,995 B2
(45) Date of Patent: Nov. 21, 2017

(54) REFRIGERATION CYCLE APPARATUS

(71) Applicant: Mitsubishi Electric Corporation, Chiyoda-ku (JP)

(72) Inventors: Shinichi Wakamoto, Chiyoda-ku (JP); Naofumi Takenaka, Chiyoda-ku (JP); Koji Yamashita, Chiyoda-ku (JP); Hiroyuki Morimoto, Chiyoda-ku (JP); Yuji Motomura, Chiyoda-ku (JP); Takeshi Hatomura, Chiyoda-ku (JP)

(73) Assignee: MITSUBISHI ELECTRIC CORPORATION, Chiyoda-ku (JP)

( * ) Notice: Subject to any disclaimer, the term of this patent is extended or adjusted under 35 U.S.C. 154(b) by 362 days.

(21) Appl. No.: 14/622,067

(22) Filed: Feb. 13, 2015

(65) Prior Publication Data

US 2015/0198360 A1 Jul. 16, 2015

Related U.S. Application Data

(62) Division of application No. 13/504,162, filed as application No. PCT/JP2009/068456 on Oct. 28, 2009, now abandoned.

(51) Int. Cl.

| | |
|---|---|
| ***F25B 13/00*** | (2006.01) |
| ***F25B 30/00*** | (2006.01) |
| ***F25B 41/04*** | (2006.01) |

(52) U.S. Cl.

CPC ..... *F25B 13/00* (2013.01); *F25B 30/00* (2013.01); *F25B 41/046* (2013.01);

(Continued)

(58) Field of Classification Search

CPC ..... F25B 6/00; F25B 6/02; F25B 6/04; F25B 2313/003; F25B 2313/0231;

(Continued)

(56) References Cited

U.S. PATENT DOCUMENTS 2,907,178 A * 10/1959 McNatt ..... F24F 3/001 62/160
5,142,879 A * 9/1992 Nakamura ..... F25B 13/00 62/160

(Continued)

FOREIGN PATENT DOCUMENTS

EP 0 448 345 A1 9/1991
JP 2 103352 4/1990

(Continued)

OTHER PUBLICATIONS

Machine Translation of JP06-109332-A,—retrieved Jul. 7, 2014.*

(Continued)

*Primary Examiner* — Hans Weiland
(74) *Attorney, Agent, or Firm* — Oblon, McClelland, Maier & Neustadt, L.L.P.

(57) ABSTRACT

A refrigeration cycle apparatus including a heat source side heat exchanger including a first heat exchanger and a second heat exchanger connected in parallel; an air-sending device that supplies air, which is an object to be heat exchanged in the first heat exchanger and the second heat exchanger, in a variable manner; solenoid valves that each opens and closes a refrigerant passage of the first heat exchanger and the second heat exchanger; a third refrigerant circuit that is parallelly connected to the first heat exchanger and the second heat exchanger; and a flow control valve that controls the flow rate of the refrigerant flowing in the third refrigerant circuit. The refrigeration cycle apparatus can improve continuity of control of a heat exchange capacity of a heat source side heat exchanger.

6 Claims, 15 Drawing Sheets

(52) U.S. Cl.
CPC ... *F25B 2309/061* (2013.01); *F25B 2313/006* (2013.01); *F25B 2313/0231* (2013.01); *F25B 2313/0252* (2013.01); *F25B 2313/0253* (2013.01); *F25B 2313/02741* (2013.01); *F25B 2600/2501* (2013.01)

(58) Field of Classification Search
CPC .... F25B 2313/0252; F25B 2313/02521; F25B 2313/0253; F25B 13/00; F25B 2313/006; F25B 2313/02741; F25B 29/003; F25B 30/00; F25B 41/046; F25B 2309/061; F25B 2600/2501
See application file for complete search history.

(56) References Cited

U.S. PATENT DOCUMENTS

| | | | | |
|---|---|---|---|---|
| 5,711,163 | A | 1/1998 | Uchikawa et al. | |
| 6,230,506 | B1 * | 5/2001 | Nishida | F25B 13/00 62/160 |
| 6,668,572 | B1 * | 12/2003 | Seo | F25B 13/00 237/2 B |
| 2005/0066678 | A1 | 3/2005 | Kamimura | |
| 2006/0254294 | A1 | 11/2006 | Shimamoto et al. | |
| 2008/0196432 | A1 | 8/2008 | Shimamoto et al. | |

FOREIGN PATENT DOCUMENTS

| | | | | |
|---|---|---|---|---|
| JP | 4 6372 | | 1/1992 | |
| JP | 5 149648 | | 6/1993 | |
| JP | 5 332630 | | 12/1993 | |
| JP | 6 109332 | | 4/1994 | |
| JP | 06109332 | A * | 4/1994 | F25B 39/028 |
| JP | 7-92296 | | 4/1995 | |
| JP | 2000 205673 | | 7/2000 | |
| JP | 2000 227261 | | 8/2000 | |
| JP | 2001 289465 | | 10/2001 | |
| JP | 2004 162945 | | 6/2004 | |
| JP | 2004162945 | A * | 6/2004 | F24F 13/30 |
| JP | 2005 49073 | | 2/2005 | |
| JP | 2005 106360 | | 4/2005 | |
| JP | 2006 97978 | | 4/2006 | |
| JP | 2006097978 | A * | 4/2006 | |
| JP | 2006-275435 | A | 10/2006 | |
| JP | 2008 76001 | | 4/2008 | |
| JP | 4211094 | | 1/2009 | |

OTHER PUBLICATIONS

Machine Translation of JP2004-162945-A,—Retrieved Jul. 10, 2014.*
Machine Translation of JP2006-097978-A,—Retrieved Jul. 10, 2014.*
Extended European Search Report dated Jul. 30, 2013 in Patent Application No. 09850827.8.
Chinese Office Action dated Dec. 2, 2013, in China Patent Application No. 200980162212.7 (with English translation).
Office Action dated May 28, 2014 in Chinese Patent Application No. 200980162212.7 (with English translation).
International Search Report dated Jan. 26, 2010 in PCT/JP09/68456 Filed Oct. 28, 2009.
Office Action dated Jun. 25, 2013 in Japanese Patent Application No. 2011-538148 (with English translation).
Machine Translation of JP2006-097978-A,—retrieved Jul. 7, 2014.
Office Action dated May 24, 2017 in European Patent Application No. 09 850 827.8.

* cited by examiner

REFRIGERATION CYCLE APPARATUS

CROSS-REFERENCE TO RELATED APPLICATIONS

This application is a divisional of and claims the benefit of priority from U.S. Ser. No. 13/504,162, filed Apr. 26, 2012, the entire contents of which is incorporated herein by reference. U.S. Ser. No. 13/504,162 is a National Stage application of PCT/JP09/068456, filed Oct. 28, 2009.

TECHNICAL FIELD

The present invention relates to a refrigeration cycle apparatus, in particular, a refrigeration cycle apparatus capable of continuously controlling a heat exchange capacity of a heat source side heat exchanger.

BACKGROUND ART

To enable continuous control of a heat exchange capacity of a heat source side heat exchanger, a conventional refrigeration cycle apparatus is proposed in, for example, Patent Literature 1 such that "a heat source unit side heat exchanger is formed by connecting a first refrigerant circuit 21, a second refrigerant circuit 22, and a third refrigerant circuit 23 that has been branched and that has been connected in parallel to each other. A first heat exchanger 24 is disposed in the first refrigerant circuit 21; a first solenoid valve 3*a* for opening/closing the heat source unit side heat exchanger is provided in one end of the first heat exchanger 24 on the four-way valve 2 side, which is capable of opening/closing a two way flow; and a third solenoid valve 3*c* for opening/closing the heat source unit side heat exchanger is provided in the other end of the first heat exchanger 24, which is capable of opening/closing a two way flow. Distribution of a refrigerant to the first refrigerant circuit 21 is controlled with the opening/closing of the two solenoid valves 3*a* and 3*c*, and whether heat exchange is carried out in the first heat exchanger 24 is controlled. A second heat exchanger 25 is disposed in the second refrigerant circuit 22; a second solenoid valve 3*b* for opening/closing the heat source unit side heat exchanger is provided in one end of the second heat exchanger 25 on the four-way valve 2 side, which is capable of opening/closing a two way flow; and a fourth solenoid valve 3*d* for opening/closing the heat source unit side heat exchanger is provided in the other end of the second heat exchanger 25, which is capable of opening/closing a two way flow. Distribution of the refrigerant to the first refrigerant circuit 22 is controlled with the opening/closing of the two solenoid valves 3*b* and 3*d*, and whether heat exchange is carried out in the second heat exchanger 25 is controlled. A solenoid valve 3*e* for bypassing the first heat source unit side heat exchanger, which is capable of opening/closing a two way flow, is disposed mid-way of the piping of the third refrigerant circuit 23, and whether there will be a refrigerant flow bypassing the first heat exchanger 24 and the second heat exchanger 25 is controlled with the opening/closing of the solenoid valve 3*e*.

. . . The capacity of the heat source unit side heat exchanger is controlled by the following four stages. . . . A first stage corresponds to a case in which the required capacity of the heat source unit side heat exchanger is the largest, . . . refrigerant is made to flow into both the first and second heat exchangers 24 and 25 and no refrigerant is made to flow into the third refrigerant circuit 23 while an air volume of a heat source unit side air-sending device 18 is controlled by controlling the air-sending device from stop to full speed with an inverter or the like (not shown). . . . A second stage corresponds to a case in which the required capacity of the heat source unit side heat exchanger is second largest next to the first stage, . . . refrigerant is made to flow into only the second heat exchanger 25 and . . . no refrigerant is made to flow into the first heat exchanger 24 and the third refrigerant circuit 23 to substantially reduce the heat transfer area of the heat source unit side heat exchanger 3 while an air volume of a heat source unit side air-sending device 18 is controlled by controlling the air-sending device from stop to full speed with an inverter or the like (not shown). . . . A third stage corresponds to a case in which the required capacity of the heat source unit side heat exchanger is smaller than that of the second stage, . . . refrigerant is made to flow into the second heat exchanger 25 and the third refrigerant circuit 23 and no refrigerant is made to flow into the first refrigerant circuit 21, that is, the first heat exchanger 24 to substantially reduce the heat transfer area of the heat source unit side heat exchanger 3 and reduce the flow rate of the refrigerant to the second heat exchanger 25 while an air volume of a heat source unit side air-sending device 18 is controlled by controlling the air-sending device from stop to full speed with an inverter or the like (not shown). . . . A fourth step corresponds to a case in which the required capacity of the heat source unit side heat exchanger is the smallest in which the solenoid valve 3*e* for bypassing the first heat source unit side heat exchanger is opened and the first, second, third, and fourth solenoid valves 3*a*, 3*b*, 3*c*, and 3*d* are closed so that there will be no heat exchange in the heat source unit side heat exchanger 3.

. . . Even if there is outside wind, the first stage and the second stage can be continuously controlled on condition that the capacity $AK2_{MAX}$ of the heat source unit side heat exchanger when the heat source unit side air-sending device 18 in the second stage is run at full speed is larger than the capacity $AK1_{MAX}$ of the heat source unit side heat exchanger when the heat source unit side air-sending device 18 is stopped, that is, when the wind velocity of the outside wind allows $AK2_{MAX}>AK1_{MAX}$. Similarly, even if there is outside wind, the second stage and the third stage can be continuously controlled on condition that the capacity $AK3_{MAX}$ of the heat source unit side heat exchanger when the heat source unit side air-sending device 18 in the third stage is run at full speed is equivalent to the outside wind of the second stage and is larger than the capacity $AK2_{MAX}$ of the heat source unit side heat exchanger when the heat source unit side air-sending device 18 is stopped, that is, when $AK3_{MAX}>AK3_{MAX}$.

CITATION LIST

Patent Literature

Patent Literature 1: Japanese Patent No. 4211094 (paragraphs 0003, 0017, and 0018 and FIGS 26 and 30)

SUMMARY OF INVENTION

Technical Problem

Incidentally, in the above conventional refrigeration cycle apparatuses, the following problems have been encountered.

First, in a supply device that supplies an object to be heat exchanged to the heat source side heat exchanger, there are cases in which the supply amount of the object to be heat exchanged to the heat source side heat exchanger cannot be continuously controlled from its maximum supply amount to zero. For example, there is an air-sending device in which its minimum rotation speed (minimum air volume) is specified so that the motor driving the air-sending device is cooled. In such an air-sending device, the control of air volume cannot be carried out continuously from full speed to stop. Accordingly, in each stage where the number of heat exchangers in which refrigerant flows in is gradually increased or decreased, there is a case in which (the minimum heat exchange capacity of the heat source side heat exchanger that is in a stage with a larger heat exchange capacity) becomes larger than (the maximum heat exchange capacity of the heat source side heat exchanger that is in a stage with a smaller heat exchange capacity). Thus, a problem has been encountered in that during shifting of each stage where the number of heat exchangers in which refrigerant flows in is gradually increased or decreased, the heat exchange capacity of the heat source side heat exchanger cannot be continuously controlled.

Further, when continuously controlling the heat exchange capacity of a heat source side heat exchanger with a supply device that cannot continuously control the supply amount of the object to be heat exchanged to the heat source side heat exchanger from maximum supply amount to zero, the number of heat exchangers constituting the heat source side heat exchanger needs to be increased so as to reduce the difference of the heat exchange capacity of each stage where the number of heat exchangers in which refrigerant flows in is gradually increased or decreased. Accordingly, the number of solenoid valves and the like that open/close the refrigerant passage to each heat exchanger disadvantageously increased.

The present invention has been made to overcome the above known problems, and an object thereof is to provide a refrigeration cycle apparatus that is capable of continuously controlling the heat exchange capacity of a heat source side heat exchanger without increasing the number of heat exchangers that constitute the heat source side heat exchanger even when the supply amount of the object to be heat exchanged to the heat source side heat exchanger cannot be continuously controlled from its maximum supply amount to zero.

Solution to Problem

A refrigeration cycle apparatus according to the invention includes a heat source side heat exchanger having a plurality of heat exchangers connected in parallel; a supply device supplying, in a variable manner, an object to be heat exchanged that exchanges heat with a refrigerant that flows in the heat exchangers to the heat exchangers;

passage on-off devices opening and closing refrigerant passages of the heat exchangers, respectively; a bypass piping being connected to the heat exchangers in parallel; and a flow control device being provided in the bypass piping, the flow control device controlling a flow rate of the refrigerant flowing in the bypass piping.

Advantageous Effects of Invention

In the invention, during shifting of each stage where a number of heat exchangers in which refrigerant flows in is gradually increased or decreased, a heat exchange capacity of a heat source side heat exchanger can be continuously controlled by distributing the refrigerant in a bypass piping and by continuously increasing or decreasing the flow rate of the refrigerant that is flowing in the bypass piping with a flow control device.

Accordingly, it will be possible to make (a minimum heat exchange capacity of a heat source side heat exchanger that is in a stage with a larger heat exchange capacity) to become smaller than (a maximum heat exchange capacity of a heat source side heat exchanger that is in a stage with a smaller heat exchange capacity) even with a supply device that cannot continuously control a supply amount of an object to be heat exchanged to the heat source side heat exchanger from maximum supply amount to zero.

Thus even in a case in which the supply amount of the object to be heat exchanged to the heat source side heat exchanger cannot be continuously controlled from its maximum supply amount to zero, it will be capable to continuously control the heat exchange capacity of the heat source side heat exchanger without increasing the number of heat exchangers that constitute the heat source side heat exchanger.

Note the distribution of the refrigerant to the bypass piping does not have to be performed in all of the stages where the number of heat exchangers in which the refrigerant flows in is gradually increased or decreased but can be performed at desired stages.

DESCRIPTION OF EMBODIMENTS

Subsequently, embodiments of the present invention will be described below with reference to the drawings.

Embodiment 1

Figure 1:
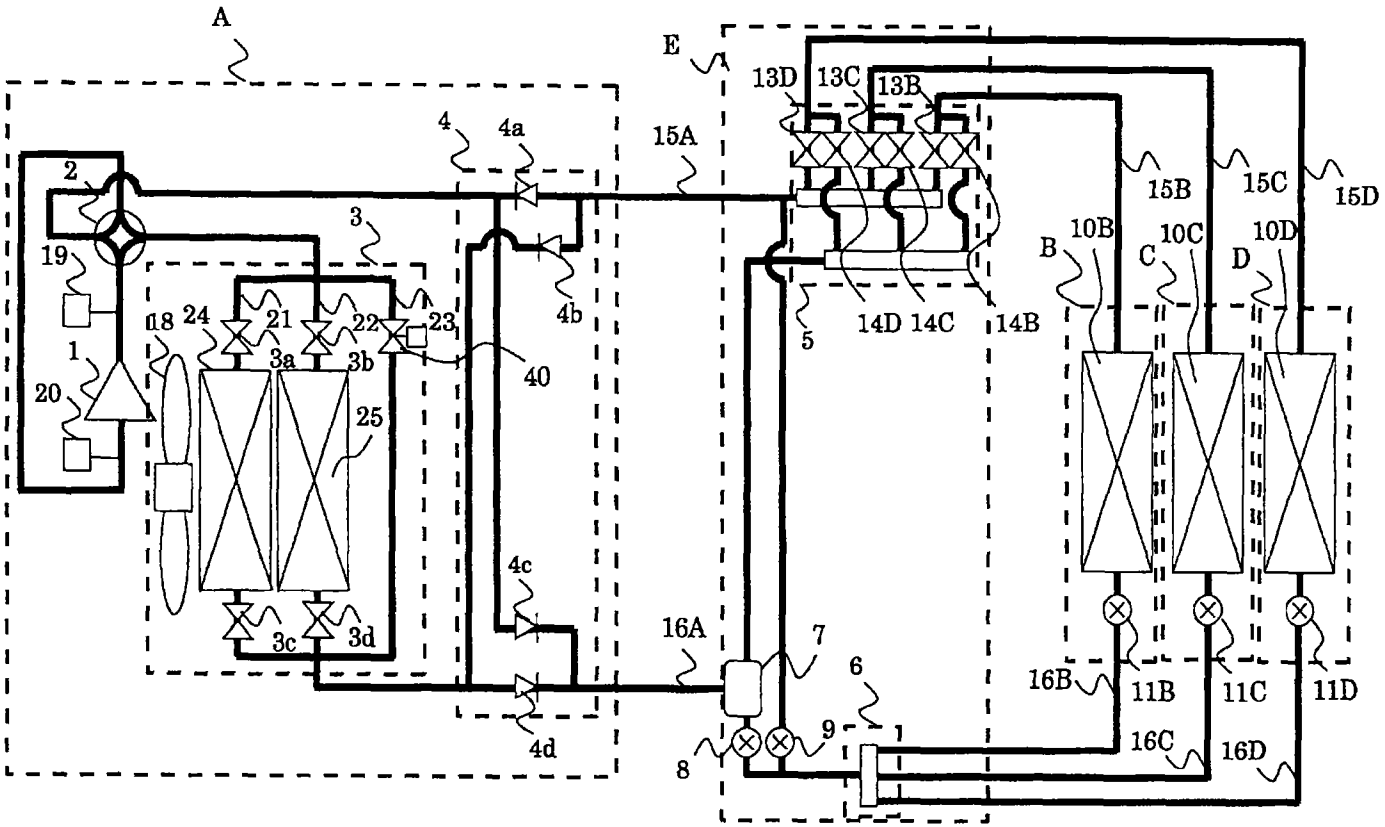
FIG. 1 is a diagram illustrating a refrigerant circuit of an air-conditioning apparatus as an example of a refrigeration cycle apparatus of Embodiment 1 of the invention.

FIG. 1 is a diagram illustrating a refrigerant circuit of an air-conditioning apparatus as an example of a refrigeration cycle apparatus of Embodiment 1 of the invention.

The air-conditioning apparatus according to Embodiment 1 is an exemplary multi-room heat pump air conditioning system in which a plurality of indoor units is connected to a single heat source unit and in which cooling can be selected in one or some indoor units while heating can be selected in one or some of the remaining indoor units. This air-conditioning apparatus includes a heat source unit A, a relay unit E, and a parallelly connected indoor units B, C, and D.

(Heat Source Unit A)

The heat source unit A includes a compressor 1, a four-way valve 2, a heat source side heat exchanger 3, an air-sending device 18, which is capable of variably controlling the volume of air and which sends air to the heat source side heat exchanger 3, and a switching valve 4 that switches a passage of a refrigerant discharged from the compressor 1.

The air-sending device 18 corresponds to the supply device of the invention. Note that in Embodiment 1, the object to be heat exchanged, which exchanges heat with the refrigerant flowing in the heat source side heat exchanger 3, is air. For example, when the object to be heat exchanged, which exchanges heat with the refrigerant flowing in the heat source side heat exchanger 3, is water or antifreeze, a pump or the like may be used as the supply device that supplies the object to be heat exchanged to the heat source side heat exchanger 3.

The heat source side heat exchanger 3 includes a plurality of heat exchangers connected in parallel. In Embodiment 1, two heat exchangers (a first heat exchanger 24 and a second heat exchanger 25) are connected in parallel. More specifically, the heat source side heat exchanger 3 includes a branched and parallelly connected a first refrigerant circuit 21, a second refrigerant circuit 22, and a third refrigerant circuit 23. The first heat exchanger 24 is disposed in the first refrigerant circuit 21. At one end of the first heat exchanger 24 on the four-way valve 2 side, a solenoid valve 3*a* is disposed, and at the other end of the first heat exchanger 24, a solenoid valve 3*c* is disposed. The opening/closing of the two solenoid valves 3*a* and 3*c* (opening/closing of the refrigerant passage) controls the distribution of the refrigerant to the first refrigerant circuit 21 and whether heat exchange is carried out in the first heat exchanger 24. The second heat exchanger 25 is disposed in the second refrigerant circuit 22. At one end of the second heat exchanger 25 on the four-way valve 2 side, a solenoid valve 3*b* is disposed, and at the other end of the first heat exchanger 25, a solenoid valve 3*d* is disposed. The opening/closing of the two solenoid valves 3*b* and 3*d* (opening/closing of the refrigerant passage) controls the distribution of the refrigerant to the second refrigerant circuit 22 and whether heat exchange is carried out in the second heat exchanger 25. A flow control valve 40 is disposed mid-way of the piping of the third refrigerant circuit 23. The flow control valve 40 controls the flow rate of the refrigerant that bypasses the first heat exchanger 24 and the second heat exchanger 25 (the flow rate of the refrigerant that flows through the third refrigerant circuit 23).

The solenoid valves 3*a* to 3*d* correspond to the passage on-off devices of the invention. The third refrigerant circuit 23 corresponds to the bypass piping of the invention. The flow control valve 40 corresponds to the flow control device of the invention. Note that although in Embodiment 1, devices with a valve structure is employed as the passage on-off devices and the flow control device, Embodiment 1 is not limited to these devices. The structure of the passage on-off device may be any that can open and close the refrigerant passage of the first heat exchanger 24 and the second heat exchanger 25. Further, the structure of the flow control device may be any that can control the flow rate of the refrigerant flowing in the third refrigerant circuit 23.

The switching valve 4 includes four check valves (first check valve 4*a*, second check valve 4*b*, third check valve 4*c*, and fourth check valve 4*d*).

The fourth check valve 4*d* is provided between the heat source side heat exchanger 3 and a second heat source unit side connecting piping 16A, and permits the refrigerant to flow only from the heat source side heat exchanger 3 to the second heat source unit side connecting piping 16A. The first check valve 4*a* is provided between the four-way valve 2 of the heat source unit A and a first heat source unit side connecting piping 15A, and permits the refrigerant to flow only from the first heat source unit side connecting piping 15A to the four-way valve 2. The third check valve 4*c* is provided between the four-way valve 2 of the heat source unit A and a second heat source unit side connecting piping 16A, and permits the refrigerant to flow only from the four-way valve 2 to the second heat source unit side connecting piping 16A. The second check valve 4*b* is a second check valve that is provided between the heat source side heat exchanger 3 and the first heat source unit side connecting piping 15A, and permits the refrigerant to flow only from the first heat source unit side connecting piping 15A to the heat source side heat exchanger 3.

The other end of the second heat source unit side connecting piping 16A is connected to a gas-liquid separator 7 of the relay unit E to be described below. The other end of the first heat source unit side connecting piping 15A is connected to a first branching unit 5 of the relay unit E to be described below.

By providing the switching valve 4, the refrigerant that has been discharged from the compressor 1 always passes through the second heat source unit side connecting piping 16A and flows into the relay unit E, and refrigerant flowing out of the relay unit E always passes through the first heat source unit side connecting piping 15A. Accordingly, the pipe diameter of the second heat source unit side connecting piping 16A can be narrower than the pipe diameter of the first heat source unit side connecting piping 15A.

Further, a condensing temperature detection device 19 and an evaporating temperature detection device 20 that are temperature sensors and the like are provided to the heat source unit A, for example. The condensing temperature detection device 19 is provided in the high-pressure portion of the refrigeration cycle and, in Embodiment 1, is provided in the discharge piping of the compressor 1. The evaporating temperature detection device 20 is provided in the low-pressure portion of the refrigeration cycle and, in Embodiment 1, is provided in the suction piping of the compressor 1.

(Indoor Units B, C, and D)

The indoor units B, C, and D each have the same configuration.

In more detail, the indoor unit B includes an indoor unit side heat exchanger 10B. One end of the indoor unit side heat exchanger 10B is connected to the first branching unit 5 of the relay unit E to be described below via a first indoor unit side connecting piping 15B. The other end of the indoor unit side heat exchanger 10B is connected to a second branching unit 6 of the relay unit E to be described below via a second indoor unit side connecting piping 16B. A flow control valve 11B is provided to the second indoor unit side connecting piping 16B.

The indoor unit C includes an indoor unit side heat exchanger 10C. One end of the indoor unit side heat exchanger 10C is connected to the first branching unit 5 of the relay unit E to be described below via a first indoor unit side connecting piping 15C. The other end of the indoor unit side heat exchanger 10C is connected to the second branching unit 6 of the relay unit E to be described below via a second indoor unit side connecting piping 16C. A flow control valve 11C is provided to the second indoor unit side connecting piping 16C.

The indoor unit D includes an indoor unit side heat exchanger 10D. One end of the indoor unit side heat exchanger 10D is connected to the first branching unit 5 of the relay unit E to be described below via a first indoor unit side connecting piping 15D. The other end of the indoor unit side heat exchanger 10D is connected to the second branching unit 6 of the relay unit E to be described below via a second indoor unit side connecting piping 16D. A flow control valve 11D is provided to the second indoor unit side connecting piping 16D.

(Relay Unit E)

The relay unit E includes the first branching unit 5, the second branching unit 6, the gas-liquid separator 7, a flow control valve 8, and a flow control valve 9.

The first branching unit 5 includes solenoid valves 13B, 13C, and 13D and solenoid valves 14B, 14C, and 14D.

One end of each of the solenoid valves 13B, 13C, and 13D is connected to the first heat source unit side connecting piping 15A. Further, the other end of the solenoid valve 13B is connected to the first indoor unit side connecting piping 15B, the other end of the solenoid valve 13C is connected to the first indoor unit side connecting piping 15C, and the other end of the solenoid valve 13D is connected to the first indoor unit side connecting piping 15D.

One end of each of the solenoid valves 14B, 14C, and 14D is connected to the gas-liquid separator 7. Further, the other end of the solenoid valve 14B is connected to the first indoor unit side connecting piping 15B, the other end of the solenoid valve 14C is connected to the first indoor unit side connecting piping 15C, and the other end of the solenoid valve 14D is connected to the first indoor unit side connecting piping 15D.

The second branching unit 6 branchingly connects the second indoor unit side connecting piping 16*b*, 16*c*, and 16*d* to the second heat source unit side connecting piping 16A. The gas-liquid separator 7 is provided in the second heat source unit side connecting piping 16A and its gas phase portion is connected to the solenoid valves 14*b*, 14*c*, and 14*d*, and its liquid phase portion is connected to the second branching unit 6. The flow control valve 8 is connected between the gas-liquid separator 7 and the second branching unit 6 and the flow control valve 9 is connected between the second branching unit 6 and the first heat source unit side connecting piping 15A. In Embodiment 1, an electronic expansion valve is employed to each of the flow control valves 8 and 9.

<Flow of Refrigerant>

Figure 2:
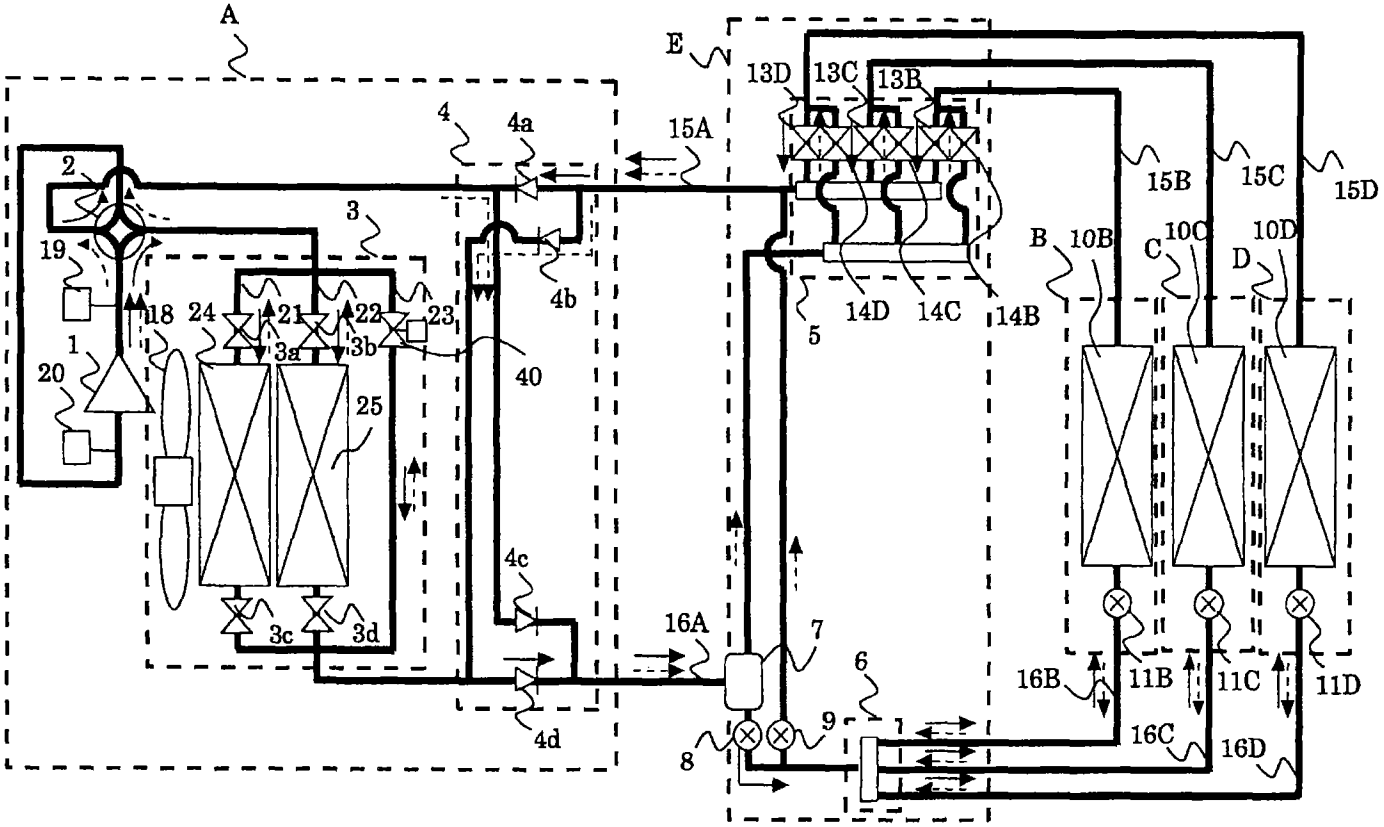
FIG. 2 is a diagram illustrating flows of a refrigerant in a refrigerant circuit of an air-conditioning apparatus during a cooling operation and a heating operation as an example of a refrigeration cycle apparatus of Embodiment 1 of the invention.
Figure 3:
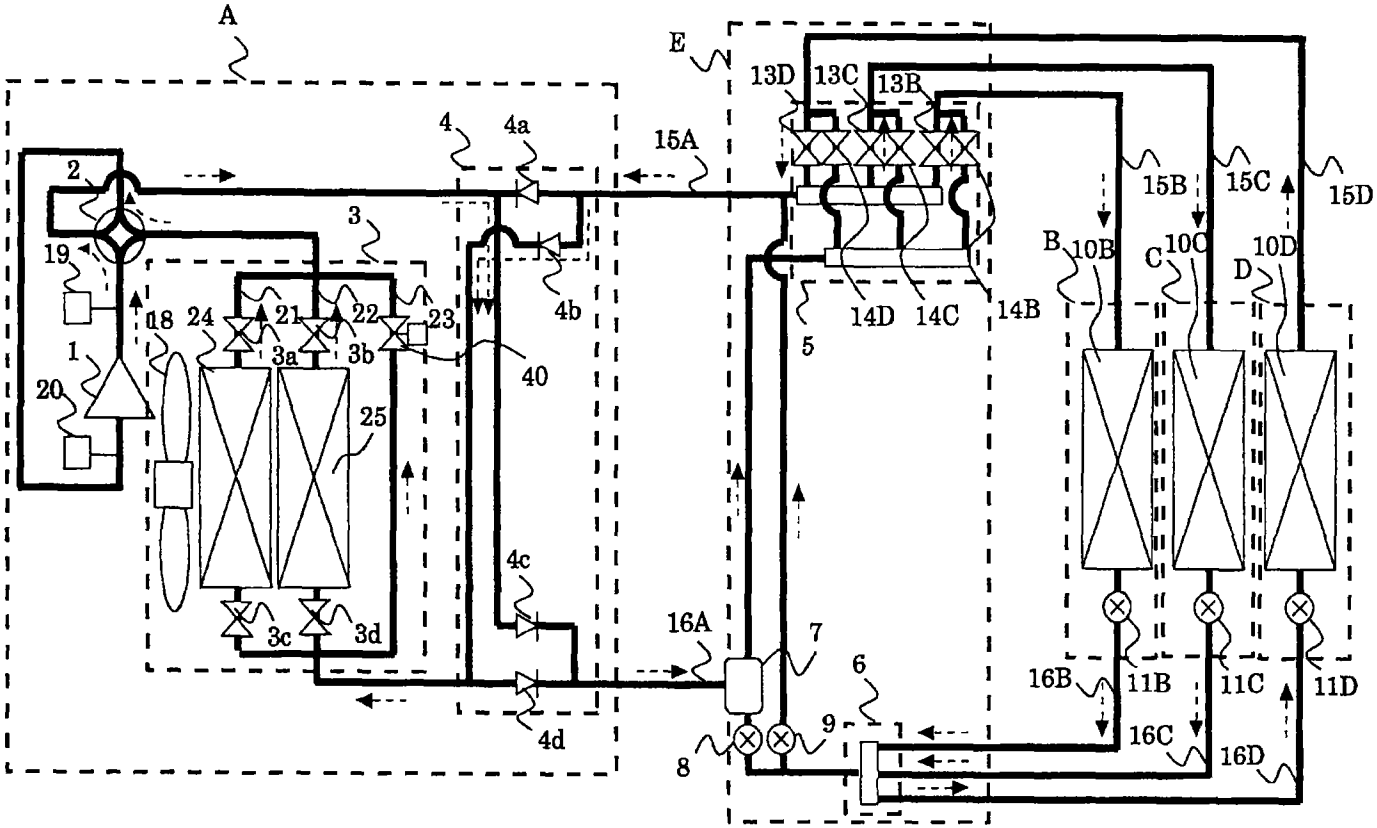
FIG. 3 is a diagram illustrating flows of a refrigerant in a refrigerant circuit of an air-conditioning apparatus during a heating main operation as an example of a refrigeration cycle apparatus of Embodiment 1 of the invention.
Figure 4:
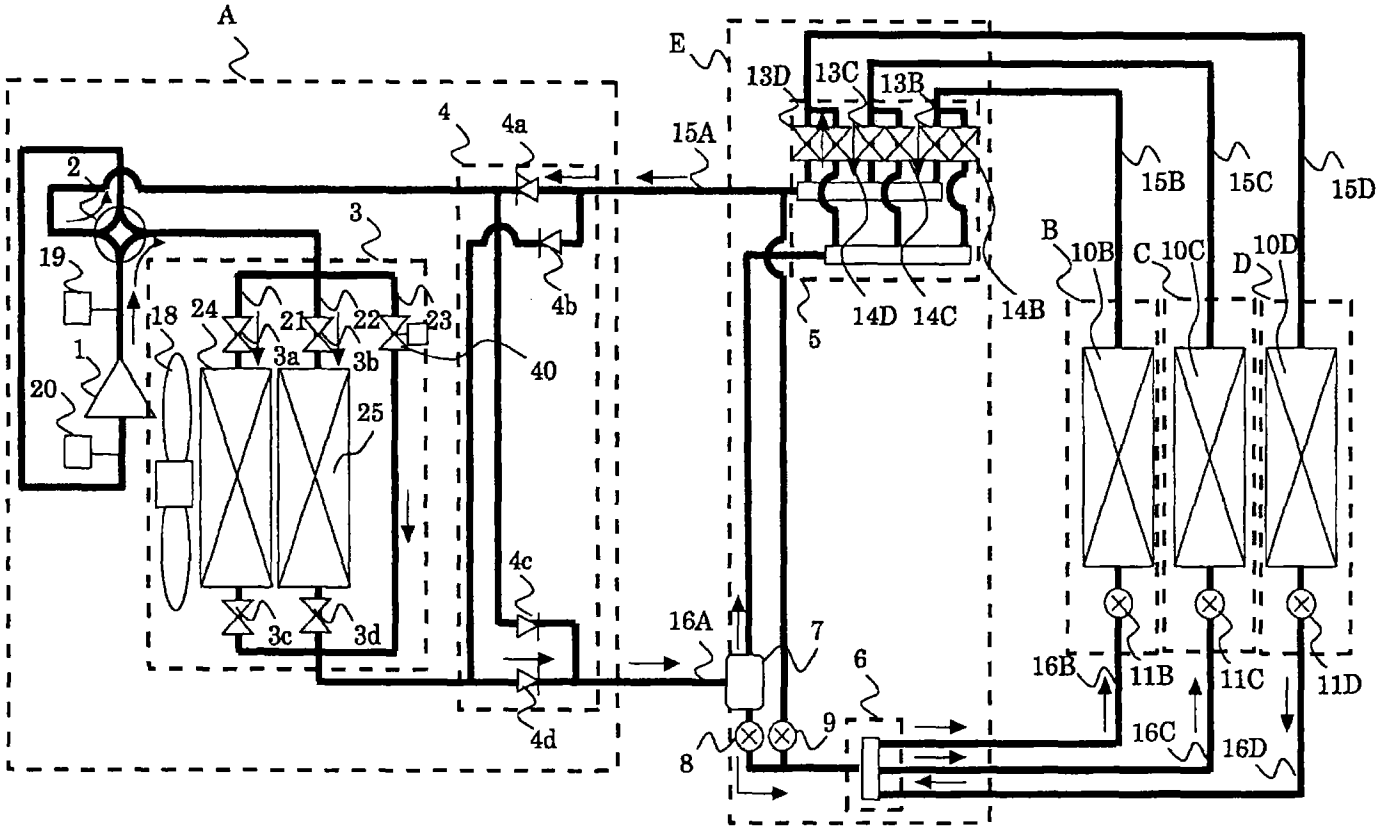
FIG. 4 is a diagram illustrating flows of a refrigerant in a refrigerant circuit of an air-conditioning apparatus during a cooling main operation as an example of a refrigeration cycle apparatus of Embodiment 1 of the invention.

The flow of the refrigerant of the air-conditioning apparatus according to Embodiment 1 will be described with reference to FIGS. 2, 3, and 4. In FIG. 2, flows of the refrigerant will be described in a case where only cooling is operated (hereinafter, referred to as a "cooling only operation") and in a case where only heating is operated (hereinafter, referred to as a "heating only operation"). In FIG. 3, a flow of the refrigerant will be described in a case where cooling and heating co-exists and the heat source side heat exchanger 3 functions as a condenser (hereinafter, referred to as a "cooling main operation"). In FIG. 4, a flow of the refrigerant will be described in a case where cooling and heating co-exists and the heat source side heat exchanger 3 functions as an evaporator (hereinafter, referred to as a "heating main operation").

(Flow of Refrigerant During Cooling Only Operation)

FIG. 2 is a diagram illustrating flows of the refrigerant in the refrigerant circuit of the air-conditioning apparatus during the cooling operation and the heating operation as an example of the refrigeration cycle apparatus of Embodiment 1 of the invention. The direction of the solid arrows in FIG. 2 indicates the direction of the refrigerant flow during the cooling only operation.

A high-temperature high-pressure gas refrigerant that has been discharged from the compressor 1 flows into the four-way valve 2. The refrigerant that has flowed out of the four-way valve 2 flows into the heat source side heat exchanger 3. The refrigerant that has flowed into the heat source side heat exchanger 3 exchanges heat with the air sent by the air-sending device 18 and is condensed and liquefied. The condensed and liquefied, high-pressure liquid refrigerant flows through the fourth check valve 4*d*, passes through the second heat source unit side connecting piping 16A, gas-liquid separator 7, and the flow control valve 8 in this order, and flows into the second branching unit 6. The high-pressure liquid refrigerant that has flowed into the second branching unit 6 passes through the second indoor unit side connecting pipings 16*b*, 16*c*, and 16*d* and flows into each of the respective indoor units B, C, and D. Further, the refrigerant that has flowed into each of the indoor units B, C, and D is decompressed to low pressure in the corresponding flow control valves 11B, 11C, and 11D, exchanges heat in the indoor unit side heat exchangers 10B, 10C, and 10D with the indoor air, and is evaporated and gasified to cool the indoor space. Note that the opening degree of each of the flow control valves 11B, 11C, and 11D is controlled on the basis of the amount of superheat at the outlet of the indoor unit side heat exchangers 10B, 10C, and 10D, respectively. Then, this refrigerant that has turned into a gaseous state passes through the first indoor unit side connecting pipings 15B, 15C, and 15D, the solenoid valves 13B, 13C, and 13D, the first branching unit 5, the first heat source unit side connecting piping 15A, the first check valve 4*a*, and the four-way valve 2, and is sucked into the compressor 1.

During the cooling only operation, the solenoid valves 13B, 13C, and 13D are opened, the solenoid valves 14B, 14C, and 14D are closed. As such, the refrigerant flows in the solid arrow direction in the first indoor unit side connecting pipings 15B, 15C, and 15D, the second indoor unit side connecting pipings 16B, 16C, and 160, and the indoor units R, C, and D. Further, since the first heat source unit side connecting piping 15A is low in pressure, the second heat source unit side connecting piping 16A is high in pressure, the end connection of the heat source side heat exchanger 3 to the switching valve 4 is high in pressure, and the end connection of the four-way valve 2 to the switching valve 4 is low in pressure, the refrigerant inevitably flows to the first check valve 4*a* and the fourth check valve 4*d*.

(Flow of Refrigerant During Heating Only Operation)

The direction of the broken-line arrows in FIG. 2 indicates the direction of the refrigerant flow during the heating only operation.

A high-temperature high-pressure gas refrigerant that has been discharged from the compressor 1 flows into the four-way valve 2. The refrigerant that has flowed out of the four-way valve 2, passes through the third check valve 4*c*, the second heat source unit side connecting piping 16A, and the gas-liquid separator 7 and flows into the first branching unit 5. The high-temperature high-pressure gas refrigerant that has flowed into the first branching unit 5 passes through each of the solenoid valves 14B, 14C, and 14D and the corresponding first indoor unit side connecting pipings 15*b*, 15*c*, and 15*d* in this order and flows into each of the respective indoor units B, C, and D. Then the high-temperature high-pressure gas refrigerant that has flowed into each of the indoor units B, C, and D exchanges heat in the respective indoor unit side heat exchangers 10B, 10C, and 10D and is condensed and liquefied to heat the indoor space.

This refrigerant that has turned into a liquid state passes through the flow control valves 11B, 11C, and 11D whose opening degree, which has been controlled on the basis of the amount of subcooling at the outlet of each of the indoor unit side heat exchangers 10B, 10C, and 10D, are in a nearly fully opened state, flows into the second branching unit 6 through the second indoor unit side connecting pipings 16B, 16C, and 16D and is merged, and further passes through the third flow control valve 9. Here, the liquid refrigerant that has left the indoor unit side heat exchangers 10B, 10C, and 10D is decompressed into a low-pressure two-phase gas-liquid state in either the flow control valves 11B, 11C, and 11D or the third flow control valve 9.

This refrigerant in a low-pressure two-phase gas-liquid state flows into the first heat source unit side connecting piping 15A. The refrigerant in a low-pressure two-phase state that has flowed into the first heat source unit side connecting piping 15A flows into the heat source side heat exchanger 3. The refrigerant that has flowed into the heat source side heat exchanger 3 exchanges heat with the air sent by the air-sending device 18, which is capable of variably controlling the volume of air, and is evaporated and gasified. The refrigerant that has turned into a gaseous state passes through the four-way valve 2 of the heat source unit and is sucked into the compressor 1.

During the heating only operation, the solenoid valves 14B, 14C, and 14D are opened, the solenoid valves 13B, 13C, and 13D are closed. As such, the refrigerant flows in the broken-line arrow direction in the first indoor unit side connecting piping 15B, 15C, and 15D, the second indoor unit side connecting piping 16B, 16C, and 16D, and the indoor units B, C, and D. Further, since the first heat source unit side connecting piping 15A is low in pressure, the second heat source unit side connecting piping 16A is high in pressure, the end connection of the heat source side heat exchanger 3 to the switching valve 4 is low in pressure, and the end connection of the four-way valve 2 to the switching valve 4 is high in pressure, the refrigerant inevitably flows to the second check valve 4*b* and the third check valve 4*c*.

(Flow of Refrigerant During Heating Main Operation)

FIG. 3 is a diagram illustrating flows of the refrigerant in the refrigerant circuit of the air-conditioning apparatus during the heating main operation as an example of the refrigeration cycle apparatus of Embodiment 1 of the invention. The direction of the broken-line arrows in FIG. 3 indicates the direction of the refrigerant flow during the heating main operation. Note that in FIG. 3, a case in which the indoor units B and C carry out heating operation and the indoor unit D carries out cooling operation is illustrated.

A high-temperature high-pressure gas refrigerant that has been discharged from the compressor 1 flows into the four-way valve 2. The refrigerant that has flowed out of the four-way valve 2, passes through the third check valve 4*c*, the second heat source unit side connecting piping 16A, and the gas-liquid separator 7 and flows into the first branching unit 5. The high-temperature high-pressure gas refrigerant that has flowed into the first branching unit 5 passes through each of the solenoid valves 14B and 14C, the corresponding first indoor unit side connecting pipings 15B and 15C in this order, and flows into each of the respective indoor units B and C. Then the high-temperature high-pressure gas refrigerant that has flowed into each of the indoor units B and C exchanges heat with the indoor air and is condensed and liquefied to heat the indoor space. This refrigerant that has turned into a liquid state passes through the flow control valves 11B and 11C whose opening degree, which has been controlled on the basis of the amount of subcooling at the outlet of each of the indoor unit side heat exchangers 10B and 10C, are in a nearly fully opened state, is slightly decompressed, and flows into the second branching unit 6 through the second indoor unit side connecting pipings 16B and 16C.

A portion of the refrigerant that has flowed into the second branching unit 6 passes through the second indoor unit side connecting piping 16D and enters the indoor unit D that is about to perform cooling. This refrigerant enters the flow control valve 11D that is controlled by the amount of superheat at the outlet of the indoor unit side heat exchanger 10D and is decompressed. The decompressed refrigerant exchanges heat in the indoor unit side heat exchanger 10D, is evaporated and gasified to cool the indoor space. This refrigerant that has turned into a gaseous state passes through the solenoid valve 13D and flows into the first heat source unit side connecting piping 15A.

Meanwhile, the remaining refrigerant in the second branching unit 6 passes through the third flow control valve 9 that is controlled such that the pressure difference between the high pressure (for example, the pressure of the second heat source unit side connecting piping 16A) and the middle pressure (for example, the pressures of the second indoor unit side connecting piping 16B, 16C, and 16D) is within a predetermined range. Subsequently, this refrigerant merges in the first heat source unit side connecting piping 15A with the refrigerant that has passed through the indoor unit D that was about to perform cooling.

The low-pressure two-phase refrigerant that has flowed into the first heat source unit side connecting piping 15A flows into the heat source unit A, passes through the second check valve 4*b*, and flows into the heat source side heat exchanger 3. Here, the refrigerant that has evaporated and has turned into a gaseous state after exchanging heat with the air sent from the air-sending device 18, which is capable of variably controlling the volume of air, flows through the four-way valve 2 of the heat source unit and is sucked into the compressor 1.

During the heating main operation, since the solenoid valves 14B and 14C are opened, and the solenoid valves 13B and 13C are closed, in the first indoor unit side connecting pipings 15B and 15C, the second indoor unit side connecting pipings 16B and 16C, and the indoor units B and C the refrigerant flows in the direction of the broken-line arrows, and heating is performed. Further, since the solenoid valve 14D is closed and the solenoid valve 13D is opened, in the first indoor unit side connecting piping 15D, the second indoor unit side connecting piping 16D, and the indoor unit D, the refrigerant flows in the direction of the broken-line arrows, and cooling is performed. Further, since the first heat source unit side connecting piping 15A is low in pressure, the second heat source unit side connecting piping 16A is high in pressure, the end connection of the heat source side heat exchanger 3 to the switching valve 4 is low in pressure, and the end connection of the four-way valve 2 to the switching valve 4 is high in pressure, the refrigerant inevitably flows to the second check valve 4*b* and the third check valve 4*c*.

(Flow of Refrigerant During Cooling Main Operation)

FIG. 4 is a diagram illustrating flows of the refrigerant in the refrigerant circuit of the air-conditioning apparatus during the cooling main operation as an example of the refrigeration cycle apparatus of Embodiment 1 of the invention. The direction of the broken-line arrows in FIG. 4 indicates the direction of the refrigerant flow during the cooling main operation. Note that in FIG. 4, a case in which the indoor units B and C carry out cooling operation and the indoor unit D carries out heating operation is illustrated.

A high-temperature high-pressure gas refrigerant that has been discharged from the compressor 1 flows into the four-way valve 2. The refrigerant that has flowed out of the four-way valve 2 flows into the heat source side heat exchanger 3. The refrigerant that has flowed into the heat source side heat exchanger 3 exchanges heat with the air sent by the air-sending device 18 and is moderately condensed and liquefied, and turns into a high-temperature high-pressure two-phase state. This high-temperature high-pressure two-phase refrigerant passes through the fourth check valve 4*d* and flows into the gas-liquid separator 7 of the relay unit E. The refrigerant that has flowed into the gas-liquid separator 7 is separated into gas refrigerant and liquid refrigerant.

The gas refrigerant that has been separated in the gas-liquid separator 7 passes through the first branching unit 5, the solenoid valve 14D, and the first indoor unit side connecting piping 15D in this order, and flows into the indoor unit D that is about to perform heating. The gas refrigerant that has flowed into the indoor unit D exchanges heat in the indoor unit side heat exchangers 10D and is condensed and liquefied to heat the indoor space. Further, the liquid refrigerant that has flowed out of the indoor unit side heat exchanger 10D is decompressed in the course of passing through the flow control valve 11D whose opening degree, which has been controlled on the basis of the amount of subcooling at the outlet of the indoor unit side heat exchanger 10D, is in a nearly fully opened state, is slightly decompressed, and flows into the second indoor unit side connecting piping 16D into the second branching unit 6.

Meanwhile, the liquid refrigerant that has been separated in the gas-liquid separator 7 passes through the flow control valve 8 that is controlled such that the pressure difference between the high pressure (for example, the pressure of the second heat source unit side connecting piping 16A) and the middle pressure (for example, the pressures of the second indoor unit side connecting piping 16B, 16C, and 16D) is within a predetermined range, and flows into the second branching unit 6. Subsequently, this refrigerant merges with the refrigerant that has passed through the indoor unit D that was about to perform heating.

The refrigerant that has flowed out from the second branching unit 6 passes through the second indoor unit side connecting pipings 16*b* and 16*c* and flows into each of the respective indoor units B and C. Then, the refrigerant that has flowed into each of the indoor units B and C is decompressed to low pressure in the corresponding flow control valves 11B and 11C, exchanges heat in the indoor unit side heat exchangers 10B and 10C with the indoor air, and is evaporated and gasified to cool the indoor space. Note that the opening degree of each of the flow control valves 11B and 11C is controlled on the basis of the amount of superheat at the outlet of the indoor unit side heat exchangers 10B, 10C, and 10D, respectively. Then, this refrigerant that has turned into a gaseous state passes through the first indoor unit side connecting pipings 15B and 15C, the solenoid valves 13B and 13C, the first branching unit 5, the first heat source unit side connecting piping 15A, the first check valve 4*a*, and the four-way valve 2, and is sucked into the compressor 1.

During the cooling main operation, since the solenoid valves 13B and 13C are opened, and the solenoid valves 14B and 14C are closed, in the first indoor unit side connecting pipings 15B and 15C, the second indoor unit side connecting pipings 16B and 16C, and the indoor units B and C the refrigerant flows in the direction of the solid arrows, and cooling is performed. Further, since the solenoid valve 13D is closed and the solenoid valve 14D is opened, in the first indoor unit side connecting piping 15D, the second indoor unit side connecting piping 16D, and the indoor unit D, the refrigerant flows in the direction of the solid arrows, and heating is performed. Further, since the first heat source unit side connecting piping 15A is low in pressure, the second heat source unit side connecting piping 16A is high in pressure, the end connection of the heat source side heat exchanger 3 to the switching valve 4 is high in pressure, and the end connection of the four-way valve 2 to the switching valve 4 is low in pressure, the refrigerant inevitably flows to the first check valve 4*a* and the fourth check valve 4*d*.

<Heat Exchange Capacity Control Method of Heat Source Side Heat Exchanger 3>

Next, the heat exchange capacity control method of the heat source side heat exchanger 3 will be described.

First, the object of controlling the heat exchange capacity of the heat source side heat exchanger 3 (more specifically, the capacity of the heat source side heat exchanger 3 and the air volume of the air-sending device 18) will be described.

To begin with, a case in which the air-conditioning apparatus of Embodiment 1 is in cooling only operation will be described. Normally, the capacity of the heat source side heat exchanger 3 and the air volume of the air-sending device 18 are designed such that the air volume of the air-sending device 18 is to be driven at full speed when the outdoor air temperature is high, and the difference between the outdoor air temperature and the condensing temperature is to be about 10 degrees C, for example. In a case where the outdoor air temperature is low, if the capacities of the heat source side heat exchanger 3 and the air-sending device 18 are controlled in the same manner as in the case where the outdoor air temperature is high, the condensing temperature will be at a temperature 10 degrees C plus the outdoor air temperature. Thus, compared to the case where the outdoor air temperature is high, the condensing temperature becomes substantially low, and the condensing pressure of the refrigeration cycle also becomes low.

As a result, the pressure difference between the outlet and the inlet of each of the flow control valves 11B, 11C, and 11D becomes small, and the opening degree of each of the flow control valves 11B, 11C, and 11D needs to be increased. The opening degree of each of the flow control valves 11B, 11C, and 11D is finite and cannot be made larger than a certain degree. If the opening degree needs to be made larger than the upper limit, a flow control valve that has a larger capacity needs to be selected. However, in such a case, the flow control valves 11B, 11C, and 11D becomes large-sized and the variation of flow rate per a minimum opening width becomes large, thus fine control cannot be performed.

Accordingly, the condensing pressure of the refrigeration cycle needs to be controlled so that it does not become excessively low by controlling the heat exchange capacity of the heat source side heat exchanger 3 (capacities of the heat source side heat exchanger 3 and the air-sending device 18) such that the condensing temperature becomes a predetermined value.

Next, a case in which the air-conditioning apparatus of Embodiment 1 is in heating only operation will be described. Normally, the capacity of the heat source side heat exchanger 3 and the air volume of the air-sending device 18 are designed such that the air volume of the air-sending device 18 is to be driven at full speed when the outdoor air temperature is low. In a case where the outdoor air temperature is high, if the capacities of the heat source side heat exchanger 3 and the air-sending device 18 are controlled in the same manner as in the case where the outdoor air temperature is low, the evaporating temperature becomes substantially high, and the evaporating pressure of the refrigeration cycle also becomes high.

As a result, the pressure difference between the outlet and the inlet of each of the flow control valves 11B, 11C, and 11D becomes small, and the opening degree of each of the flow control valves 11B, 11C, and 11D needs to be increased. The opening degree of each of the flow control valves 11B, 11C, and 11D is finite and cannot be made larger than a certain degree. If the opening degree needs to be made larger than the upper limit, a flow control valve that has a larger capacity needs to be selected. However, in such a case, the flow control valves 11B, 11C, and 11D becomes large-sized and the variation of flow rate per a minimum opening width becomes large, thus fine control cannot be performed.

Accordingly, the evaporating pressure of the refrigeration cycle needs to be controlled so that it does not become excessively high by controlling the heat exchange capacity of the heat source side heat exchanger 3 (capacities of the heat source side heat exchanger 3 and the air-sending device 18) such that the evaporating temperature becomes a predetermined value.

Next, a case in which the air-conditioning apparatus of Embodiment 1 is in cooling main operation will be described. Normally, the capacity of the heat source side heat exchanger 3 and the air volume of the air-sending device 18 are designed such that, during the cooling only operation, the air volume of the air-sending device 18 is to be driven at full speed when the outdoor air temperature is high, and the difference between the outdoor air temperature and the condensing temperature is to be about 10 degrees C, for example. Normally, the outdoor air temperature is low since a heating load is generated in the cooling main operation. During the cooling main operation, if the capacities of the heat source side heat exchanger 3 and the air-sending device 18 are controlled in the same manner as in the case where the outdoor air temperature is high during the cooling only operation, the condensing temperature is reduced by the amount of the outdoor temperature drop and further by the amount of condensation in the heating indoor unit D. Accordingly, the capacity of the heating indoor unit D becomes insufficient. Hence, the heat exchange capacity of the heat source side heat exchanger 3 (capacities of the heat source side heat exchanger 3 and the air-sending device 18) needs to be controlled such that the condensing temperature becomes a predetermined value.

Next, a case in which the air-conditioning apparatus of Embodiment 1 is in heating main operation will be described. Normally, the capacity of the heat source side heat exchanger 3 and the air volume of the air-sending device 18 are designed such that, during the heating only operation, the air volume of the air-sending device 18 is to be driven at full speed when the outdoor air temperature is low. Normally, the outdoor air temperature is relatively high since a cooling load is generated in the heating main operation. During the heating main operation, if the capacities of the heat source side heat exchanger 3 and the air-sending device 18 are controlled in the same manner as in the case where the outdoor air temperature is low during the heating only operation, the evaporating temperature is increased by the amount of the outdoor temperature rise and further by the amount of evaporation in the cooling indoor unit D. Accordingly, the capacity of the cooling indoor unit D becomes insufficient. Hence, the heat exchange capacity of the heat source side heat exchanger 3 (capacities of the heat source side heat exchanger 3 and the air-sending device 18) needs to be controlled such that the evaporating temperature becomes a predetermined value.

Accordingly, in the air-conditioning apparatus according to Embodiment 1, a heat exchange capacity regulating device 152 controls the heat exchange capacity of the heat source side heat exchanger 3 as below.

Figure 5:
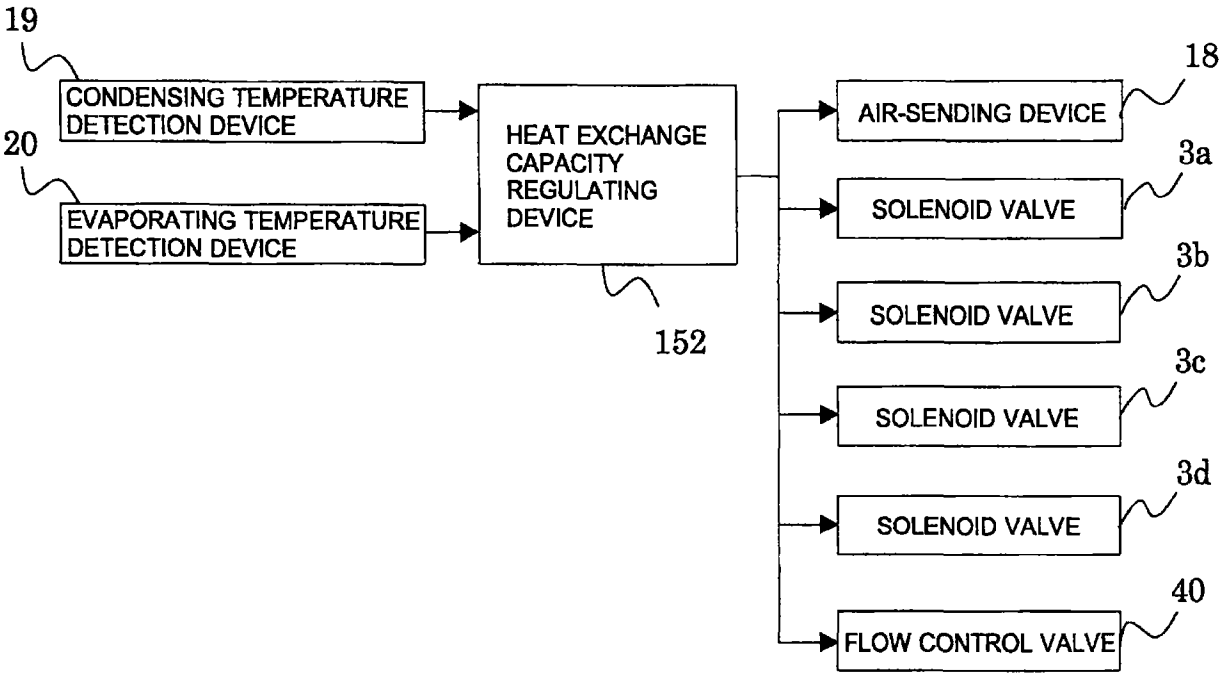
FIG. 5 is a diagram illustrating a control content of a heat exchange capacity regulating device of an air-conditioning apparatus as an example of a refrigeration cycle apparatus of Embodiment 1 of the invention.

FIG. 5 is a diagram illustrating a control content of the heat exchange capacity regulating device of the air-conditioning apparatus as an example of the refrigeration cycle apparatus of Embodiment 1 of the invention. The heat exchange capacity regulating device 152 controls the air volume (capacity) of the air-sending device 18, the opening/closing of the solenoid valves 3*a*, 3*b*, 3*c*, and 3*d*, and the opening degree of the flow control valve 40 on the basis of the detection temperature of the condensing temperature detection device 19 and the evaporating temperature detection device 20.

Specifically, the heat exchange capacity of the heat source side heat exchanger 3 is controlled by four steps described below.

A first stage corresponds to a case in which the heat source side heat exchanger 3 is required to have the largest heat exchange capacity. By opening the solenoid valves 3*a*, 3*b*, 3*c*, and 3*d* and closing the flow control valve 40, the refrigerant is distributed to the first and second refrigerant circuits 21 and 22 and no refrigerant is distributed to the third refrigerant circuit 23. That is, the refrigerant is distributed to both the first heat exchanger 24 and the second heat exchanger 25 and no refrigerant is distributed to the third refrigerant circuit 23. Further, the air volume of the air-sending device 18 is controlled by an inverter or the like (not illustrated) between minimum air volume and full speed.

In a case where there is outside wind, such as building-induced wind, even if the air-sending device 18 is set to its minimum air volume, a considerably large amount of heat will be exchanged. Accordingly, if the heat source side heat exchanger 3 is a condenser, the condensing temperature drops, and if an evaporator, the evaporating temperature rises. Further, in a case where there is no outside wind, if the temperature difference between the outdoor air temperature and the condensing temperature or the evaporating temperature of the refrigerant in the heat source side heat exchanger 3 is large, the condensing temperature drops or the evaporating temperature rises since a heat exchange capacity below the amount of heat exchange by free convection cannot be obtained.

A second stage corresponds to a case in which the heat source side heat exchanger 3 is required to have the second largest heat exchange capacity next to the first stage. In the second stage, the solenoid valves 3*a* and 3*c* are opened, the solenoid valves 3*b* and 3*d* are closed, and the flow control valve 40 is closed. As such, the refrigerant is distributed only to the first refrigerant circuit 23 and no refrigerant is distributed to the second refrigerant circuit 22 and the third refrigerant circuit 23. That is, the refrigerant is only distributed to the first heat exchanger 24 and no refrigerant is distributed to the second heat exchanger 25 and the third refrigerant circuit 23 to substantially reduce the heat transfer area of the heat source side heat exchanger 3. Further, the air volume of the air-sending device 18 is controlled by an inverter or the like (not illustrated) between minimum air volume and full speed.

In this case, the amount of heat exchange by the outside wind, such as a building-induced wind, is substantially reduced, and the amount of heat exchange by free convection when there is no outside wind is substantially reduced. Accordingly, when the heat source side heat exchanger 3 is a condenser, the drop in condensing temperature becomes small, and when an evaporator, the rise in evaporating temperature becomes small.

A third stage corresponds to a case in which the heat source side heat exchanger 3 is required to have a smaller heat exchange capacity than that of the second stage. In the third stage, the solenoid valves 3*a* and 3*c* are opened, the solenoid valves 3*b* and 3*d* are closed, and the flow control valve 40 is controlled. As such, the refrigerant is distributed to the first refrigerant circuit 21 and the third refrigerant circuit 23 and no refrigerant is distributed to the second refrigerant circuit 22. That is, the refrigerant is distributed to both the first heat exchanger 24 and the third refrigerant circuit 23 and no refrigerant is distributed to the second heat exchanger 25. Further, the air volume of the air-sending device 18 is controlled by an inverter or the like (not illustrated) between minimum air volume and full speed. At this time, by controlling the opening degree of the flow control valve 40, the amount of refrigerant distributed in the second refrigerant circuit 23 can be continuously controlled and the heat exchange capacity of the heat source side heat exchanger 3 (more specifically, the first heat exchanger 24) can be continuously controlled.

In this case, the amount of heat exchange by the outside wind, such as a building-induced wind, is further reduced from the second stage and the amount of heat exchange by free convection when there is no outside wind is reduced in the same manner. Accordingly, when the heat source side heat exchanger 3 is a condenser, the drop in condensing temperature becomes further small, and when an evaporator, the rise in evaporating temperature becomes further small.

A fourth stage corresponds to a case in which the heat source side heat exchanger 3 is required to have the smallest heat exchange capacity. By fully opening the flow control valve 40 and closing the solenoid valves 3*a*, 3*b*, 3*c*, and 3*d*, there will be no heat exchange in the heat source side heat exchanger 3.

Note that in Embodiment 1, in the second stage, the refrigerant passage of the second heat exchanger 25 is closed (closing the solenoid valves 3*b* and 3*d*), and in the fourth stage, the refrigerant passage of the first heat exchanger 24 is closed (closing the solenoid valves 3*a* and 3*c*). Not to limited to the above, in the second stage, the refrigerant passage of the first heat exchanger 24 may be closed (closing the solenoid valves 3*a* and 3*c*), and in the fourth stage, the refrigerant passage of the second heat exchanger 25 may be closed (closing the solenoid valves 3*b* and 3*d*).

Next, the continuity of control by the heat exchange capacity regulating device 152 in the first stage, the second stage, the third stage, and the fourth stage will be described. Even if there is outside wind, the first stage and the second stage can be continuously controlled on condition that (the capacity $AK2_{MAX}$ of the heat source unit side heat exchanger when the heat source unit side air-sending device 18 in the second stage is run at full speed) is larger than (the capacity $AK1_{MAX}$ of the heat source unit side heat exchanger when the heat source unit side air-sending device 18 in the first stage is run at minimum air volume), that is, when the wind velocity of the outside air allows $AK2_{MAX}>AK1_{MAX}$.

Similarly, even if there is outside wind, the second stage and the third stage can be continuously controlled on condition that (the capacity $AK3_{MAX}$ of the heat source unit side heat exchanger when the heat source unit side air-sending device 18 in the third stage is run at full speed) is larger than (the capacity $AK2_{MAX}$ of the heat source unit side heat exchanger when the heat source unit side air-sending device 18 in the second stage is run at minimum air volume), that is, when the wind velocity of the outside air allows $AK3_{MAX}>AK2_{MAX}$.

In Embodiment 1, the increase and decrease in the amount of refrigerant flowing in the third refrigerant circuit 23 can be continuously controlled. Thus, by reducing the amount of refrigerant flowing in the second refrigerant circuit 23, the capacity $AK3_{MAX}$ of the heat source unit side heat exchanger when the heat source unit side air-sending device 18 in the third stage is run at full speed can be increased. Therefore, compared to conventional air-conditioning apparatuses, continuous control of shifting from the second stage to the third stage is facilitated.

As above, by controlling the bypass flow rate of the heat source side heat exchanger 3 (the flow rate of the refrigerant flowing in the third refrigerant circuit 23) and by controlling the heat exchange capacity of the heat source side heat exchanger 3 in four stages, even if there is a certain amount of outside wind, the heat exchange capacity of the heat source side heat exchanger 3 can be continuously controlled. That is, when the heat source side heat exchanger 3 is a condenser, the condensing temperature can be controlled to be at a predetermined value or within a predetermined range, and when an evaporator, the evaporating temperature can be controlled to be at a predetermined value or within a predetermined range.

Note that distribution of the refrigerant to the third refrigerant circuit 23 is not limited to the stages mentioned above. For example, the refrigerant may be distributed to the third refrigerant circuit 23 in the first stage. By distributing the refrigerant to the third refrigerant circuit 23 in the first stage, the capacity $AK1_{MAX}$ of the heat source unit side heat exchanger when the heat source unit side air-sending device 18 in the first stage is run at minimum air volume is reduced. This capacity $AK1_{MAX}$ of the heat source unit side heat exchanger becomes smaller, the larger the refrigerant flow rate to the third refrigerant circuit 23 becomes. Accordingly, compared to conventional air-conditioning apparatuses, continuous control of shifting from the second stage to the third stage can be carried out. Therefore, compared to conventional air-conditioning apparatuses, continuous control of shifting from the first stage to the second stage is facilitated.

Next, the control content of the heat exchange capacity regulating device 152 when the heat source side heat exchanger 3 is a condenser will be described with the flowchart in FIG. 6.

Figure 6:
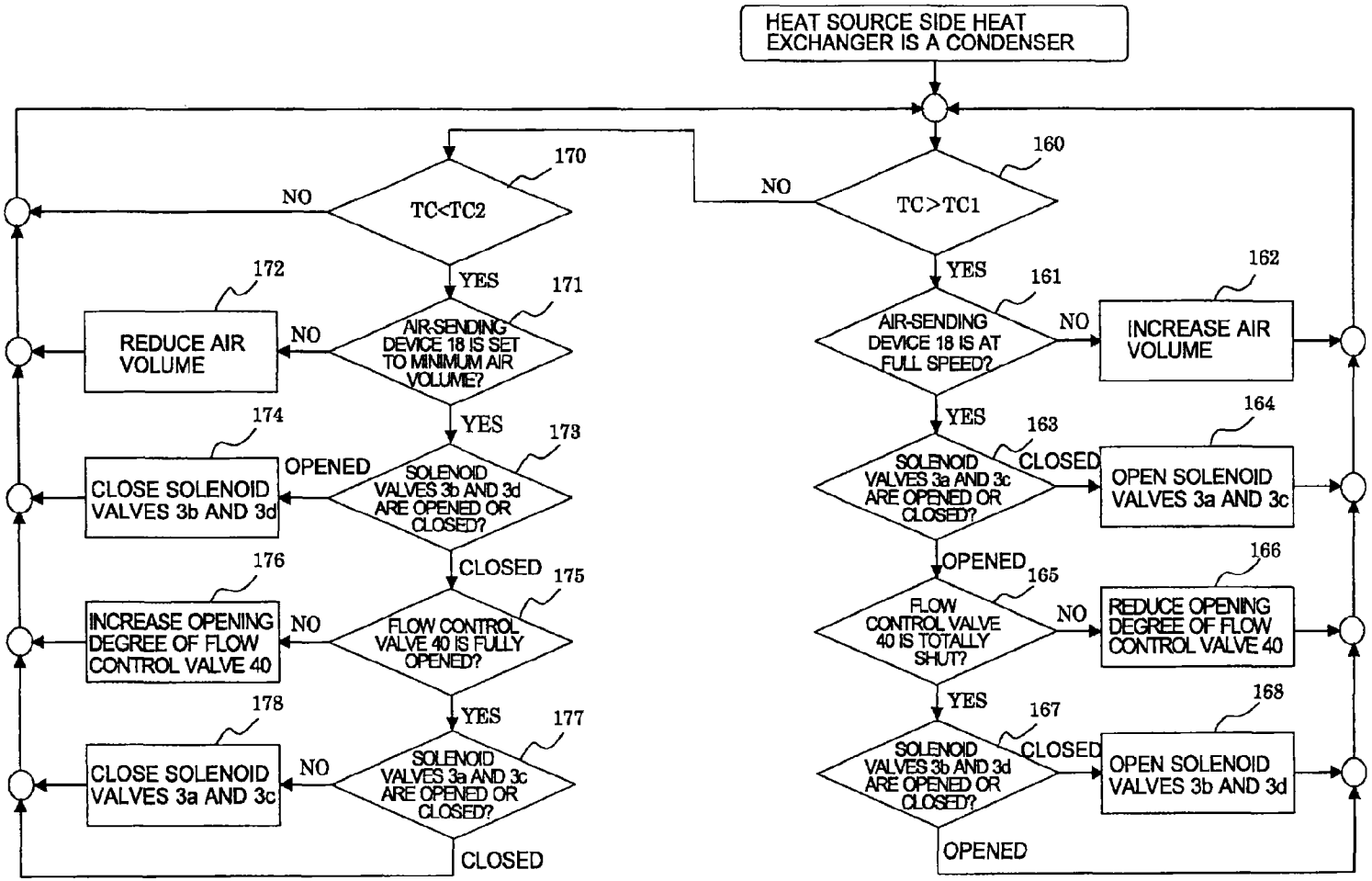
FIG. 6 is a diagram illustrating a control flow of a heat exchange capacity regulating device when the heat source side heat exchanger of an air-conditioning apparatus is functioning as a condenser as an example of a refrigeration cycle apparatus of Embodiment 1 of the invention.

FIG. 6 is a diagram illustrating a control flow of the heat exchange capacity regulating device when the heat source side heat exchanger of the air-conditioning apparatus is functioning as a condenser as an example of the refrigeration cycle apparatus of Embodiment 1 of the invention.

In step 160, (a detection temperature TC of the condensing temperature detection device 19) and (a prescribed first target condensing temperature TC1) are compared. If TC>TC1, control proceeds to step 161. In step 161, whether the air-sending device 18 is at full speed or not is determined. If the air-sending device 18 is not at full speed, the control proceeds to step 162 and increases the air volume, and then returns to step 160. If the air-sending device 18 is at full speed, in step 163, the opening/closing of each of the solenoid valves 3*a* and 3*c* is determined. If the solenoid valves 3*a* and 3*c* are closed, in step 164, the solenoid valves 3*a* and 3*c* are opened to open the first refrigerant circuit 21, that is, the first heat exchanger 24, and then the control returns to step 160. If the solenoid valves 3*a* and 3*c* are opened, the control proceeds to step 165.

In step 165, the opening degree of the flow control valve 40 is determined. If the flow control valve 40 is not totally closed, in step 166, the opening degree of the flow control valve 40 is reduced, and then the control returns to step 160. If the opening degree of the flow control valve 40 is totally closed, the control proceeds to step 167. In step 167, the opening/closing of each of the solenoid valves 3*b* and 3*d* is determined. If the solenoid valves 3*b* and 3*d* are closed, in step 168, the solenoid valves 3*b* and 3*d* are opened to open the second refrigerant circuit 22, that is, the second heat exchanger 25, and then the control returns to step 160. If the solenoid valves 3*b* and 3*d* are opened, the control also returns to step 160.

On the other hand, if TC≤TC1 is determined in step 160, the control proceeds to step 170. In step 170, (a detection temperature TC of the condensing temperature detection device 19) and (a prescribed second target condensing temperature TC2 that is set smaller than the first target condensing temperature) are compared. If TC<TC2, the control proceeds to step 171, and if TC≥TC2, the control returns to step 160. In step 171, whether the air-sending device 18 is set to minimum air volume or not is determined. If the air-sending device 18 is not set to minimum air volume, the control proceeds to step 172 and decreases the air volume, and then returns to step 160. If the air-sending device 18 is set to minimum air volume, in step 173, the opening/closing of each of the solenoid valves 3*b* and 3*d* is determined. If the solenoid valves 3*b* and 3*d* are opened, in step 174, the solenoid valves 3*b* and 3*d* are closed to close the second refrigerant circuit 22, that is, the second heat exchanger 25, and then the control returns to step 160. If the solenoid valves 3*b* and 3*d* are closed, the control proceeds to step 175.

In step 175, the opening degree of the flow control valve 40 is determined. If the flow control valve 40 is not fully opened, in step 176, the opening degree of the flow control valve 40 is increased, and then the control returns to step 160. If the opening degree of the flow control valve 40 is fully opened, the control proceeds to step 177. In step 177, the opening/closing of each of the solenoid valves 3*a* and 3*c* is determined. If the solenoid valves 3*a* and 3*c* are opened, in step 178, the solenoid valves 3*a* and 3*c* are closed to close the first refrigerant circuit 21, that is, the first heat exchanger 24, and then the control returns to step 160. In step 177, if the solenoid valves 3*a* and 3*c* are closed, the control also returns to step 160.

With the above, the detection temperature TC of the condensing temperature detection device 19 can be controlled to a temperature between the first target condensing temperature TC1 and the second target condensing temperature TC2.

Next, the control content of the heat exchange capacity regulating device 152 when the heat source side heat exchanger 3 is an evaporator will be described with the flowchart in FIG. 7.

Figure 7:
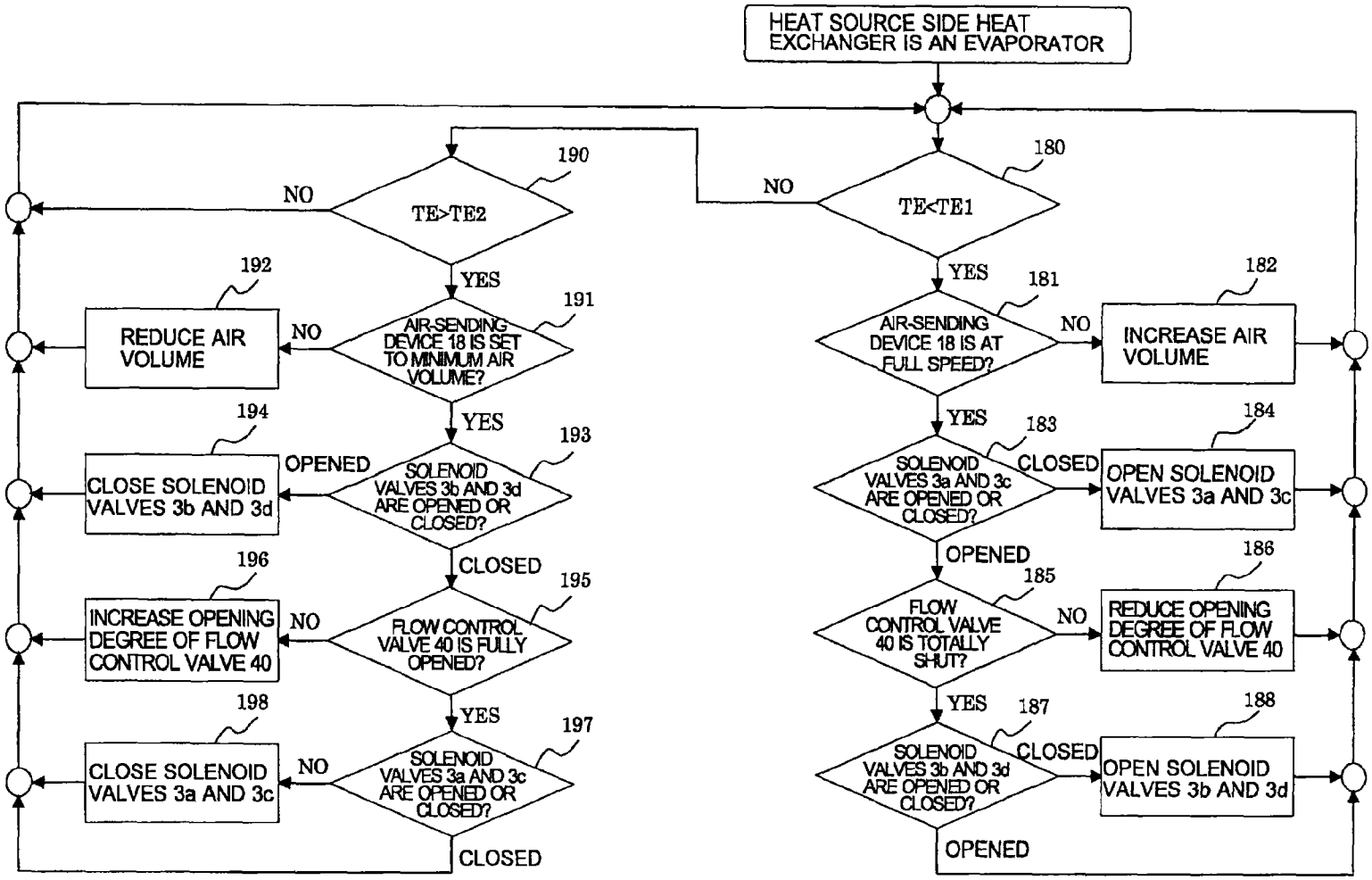
FIG. 7 is a diagram illustrating a control flow of a heat exchange capacity regulating device when the heat source side heat exchanger of an air-conditioning apparatus is functioning as an evaporator as an example of a refrigeration cycle apparatus of Embodiment 1 of the invention.

FIG. 7 is a diagram illustrating a control flow of a heat exchange capacity regulating device when the heat source side heat exchanger of an air-conditioning apparatus is functioning as an evaporator as an example of a refrigeration cycle apparatus of Embodiment 1 of the invention.

In step 180, (a detection temperature TE of the evaporating temperature detection device 20) and (a prescribed first target evaporating temperature TE1) are compared. If TE<TE1, control proceeds to step 181. In step 181, whether the air-sending device 18 is at full speed or not is determined. If the air-sending device 18 is not at full speed, the control proceeds to step 182 and increases the air volume, and then returns to step 180. If the air-sending device 18 is at full speed, in step 183, the opening/closing of each of the solenoid valves 3*a* and 3*c* is determined. If the solenoid valves 3*a* and 3*c* are closed, in step 184, the solenoid valves 3*a* and 3*c* are opened to open the first refrigerant circuit 21, that is, the first heat exchanger 24, and then the control returns to step 180. If the solenoid valves 3*a* and 3*c* are opened, the control proceeds to step 185.

In step 185, the opening degree of the flow control valve 40 is determined. If the flow control valve 40 is not totally closed, in step 186, the opening degree of the flow control valve 40 is reduced, and then the control returns to step 180. If the opening degree of the flow control valve 40 is totally closed, the control proceeds to step 187. In step 187, the opening/closing of each of the solenoid valves 3*b* and 3*d* is determined. If the solenoid valves 3*b* and 3*d* are closed, in step 188, the solenoid valves 3*b* and 3*d* are opened to open the second refrigerant circuit 22, that is, the second heat exchanger 25, and then the control returns to step 180. If the solenoid valves 3*b* and 3*d* are opened, the control also returns to step 180.

On the other hand, if TE≥TE1 is determined in step 180, the control proceeds to step 190. In step 190, (a detection temperature TE of the evaporating temperature detection device 20) and (a prescribed second target evaporating temperature TE2 that is set larger than the first target condensing temperature) are compared. If TE>TE2, the control proceeds to step 191, and if TE≤TE2, the control returns to step 180. In step 191, whether the air-sending device 18 is set to minimum air volume or not is determined. If the air-sending device 18 is not set to minimum air volume, the control proceeds to step 192 and decreases the air volume, and then returns to step 180. If the air-sending device 18 is set to minimum air volume, in step 193, the opening/closing of each of the solenoid valves 3*b* and 3*d* is determined. If the solenoid valves 3*b* and 3*d* are opened, in step 194, the solenoid valves 3*b* and 3*d* are closed to close the second refrigerant circuit 22, that is, the second heat exchanger 25, and then the control returns to step 180. If the solenoid valves 3*b* and 3*d* are closed, the control proceeds to step 195.

In step 195, the opening degree of the flow control valve 40 is determined. If the flow control valve 40 is not fully opened, in step 196, the opening degree of the flow control valve 40 is increased, and then the control returns to step 180. If the opening degree of the flow control valve 40 is fully opened, the control proceeds to step 197. In step 197, the opening/closing of each of the solenoid valves 3*a* and 3*c* is determined. If the solenoid valves 3*a* and 3*c* are opened, in step 198, the solenoid valves 3*a* and 3*c* are closed to close the first refrigerant circuit 21, that is, the first heat exchanger 24, and then the control returns to step 180. In step 197, if the solenoid valves 3*a* and 3*c* are closed, the control also returns to step 180.

With the above, the detection temperature TE of the evaporating temperature detection device 20 can be controlled to a temperature between the first target evaporating temperature TE1 and the second target evaporating temperature TE2.

With the air-conditioning apparatus of the above configuration, even in a case in which the control range of the air volume of the air-sending device 18 cannot be continuously controlled from full speed to stop, by controlling the flow rate of the refrigerant flowing in the third refrigerant circuit 23, the heat exchange capacity of the heat source side heat exchanger 3 can be continuously controlled.

Further, unlike conventional air-conditioning apparatuses, the number of heat exchangers constituting the heat source side heat exchanger 3 does not have to be increased in order to reduce the difference between each heat exchange capacity of the heat source side heat exchanger 3 in each stage. Accordingly, increase in the number of solenoid valves and the like that is required to open/close the refrigerant passage to each heat exchanger constituting the heat source side heat exchanger 3 can be avoided.

Figure 8:
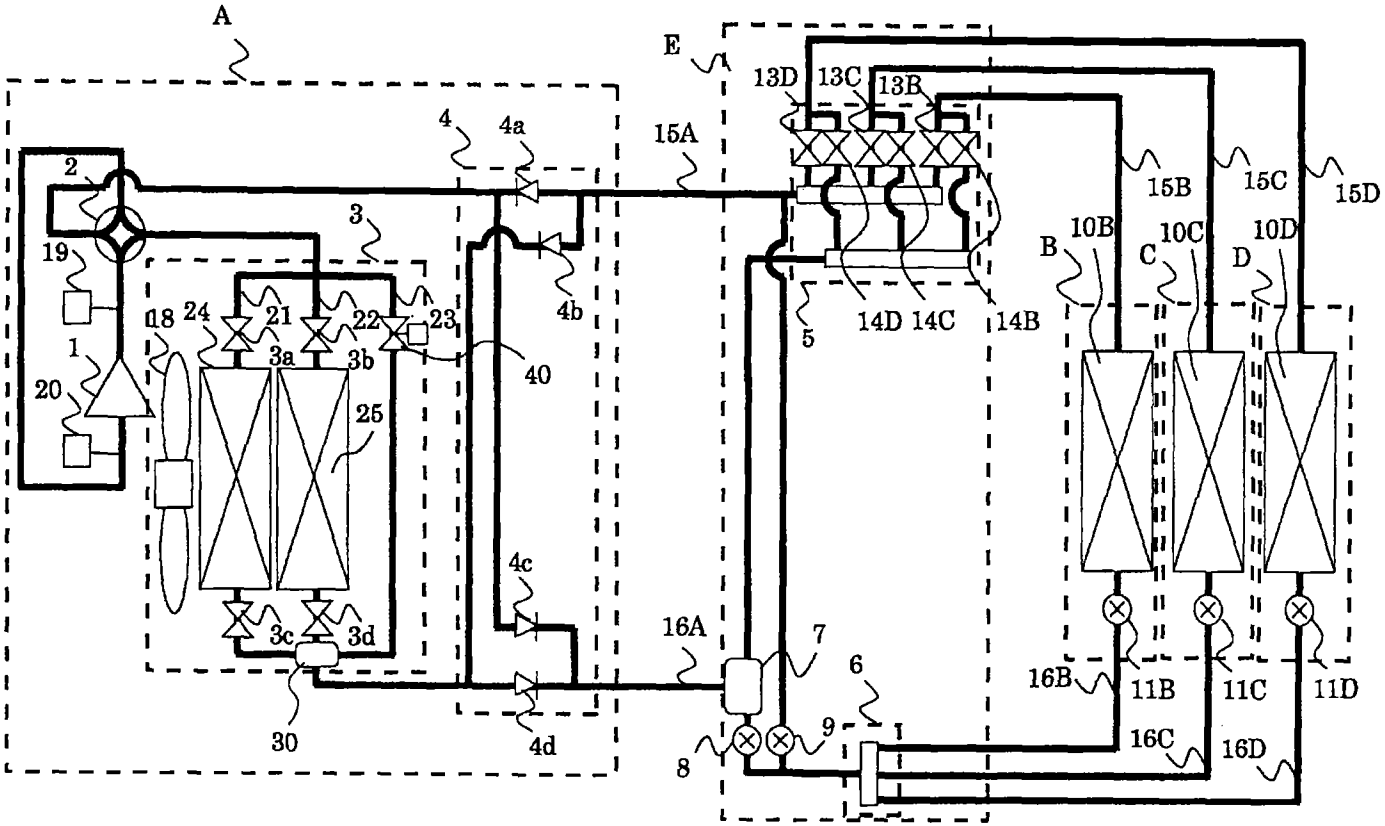
FIG. 8 is a diagram illustrating a refrigerant circuit of an air-conditioning apparatus as another example of a refrigeration cycle apparatus of Embodiment 1 of the invention.

Note that as illustrated in FIG. 8, a distributor 30 that regulates the gas-to-liquid ratio of the two-phase gas-liquid refrigerant to a prescribed ratio (for example, equal) and that sends out the refrigerant downstream may be provided to a junction of the first refrigerant circuit 21, second refrigerant circuit 22, and the third refrigerant circuit 23, in which the junction is the junction on the inlet side when the heat source side heat exchanger 3 is an evaporator. In the air-conditioning apparatus configured as above, when the heat source side heat exchanger 3 operates as an evaporator, even with a flow of a low-pressure two-phase gas-liquid refrigerant, the refrigerant can be distributed with, for example, an equal gas-to-liquid ratio to each refrigerant circuits (the first refrigerant circuit 21, the second refrigerant circuit 22, and the third refrigerant circuit 23). Accordingly, a refrigerant with an excessively high gas ratio or, on the other hand, a refrigerant with an excessively high liquid ratio flowing into the heat source side heat exchanger 3, and, consequently, rendering the heat exchange capacity of the heat source side heat exchanger 3 to be unstable can be prevented. That is, an advantageous effect is obtained in which the heat exchange capacity of the heat source side heat exchanger 3 can be controlled in a stable manner.

Further, although in Embodiment 1, the refrigerant that is used has not been mentioned in particular, a refrigerant that, when heating the object to be heat exchanged (air, water, or the like) in the condenser, heats the object to be heat exchanged in a supercritical state without condensing may be used. By using such a refrigerant, the gas-liquid separator 7 will not be needed to be provided in the refrigerant circuit of the air-conditioning apparatus. Accordingly, an advantageous effect in which an efficient operation of the air-conditioning apparatus during the cooling main operation can be obtained without increasing pressure loss in the heating indoor unit and decreasing the heating capacity.

Furthermore, the air-conditioning apparatus shown in Embodiment 1 is merely an example. For example, the heat source unit A and the relay unit E may be a single unit (the components of the heat source unit A and the components of the relay unit E may be disposed in a singular housing). The air-conditioning apparatus may be one that is capable of performing only the cooling only operation or the heating only operation, for example. In this case, the four-way valve 2 and the switching valve 4 will not be needed to be provided in the heat source unit A. For example, the air-conditioning apparatus may be one with a single indoor unit rather than a multi-room air-conditioning system having a plurality of indoor units.

Furthermore, it goes without saying that the refrigeration cycle apparatus of the invention can be employed to a device other than the air-conditioning apparatus. For example, the refrigeration cycle apparatus according to the invention can be employed to a hot water storage hot water device and the like.

Embodiment 2

When using a heat source side heat exchanger 3 with a plurality of heat exchangers connected in parallel as a condenser, there are cases in which the density of the refrigerant that is flowing in the heat source side heat exchanger becomes high, resulting in drop of flow velocity. This raises a concern of drop of the heat transfer coefficient of the refrigerant (the heat exchange efficiency of the heat source side heat exchanger 3). By adding the below configuration, this matter of concern can be resolved, and a further efficient air-conditioning apparatus can be obtained. Note that in Embodiment 2, elements not stated in particular is the same as Embodiment 1.

Figure 9:
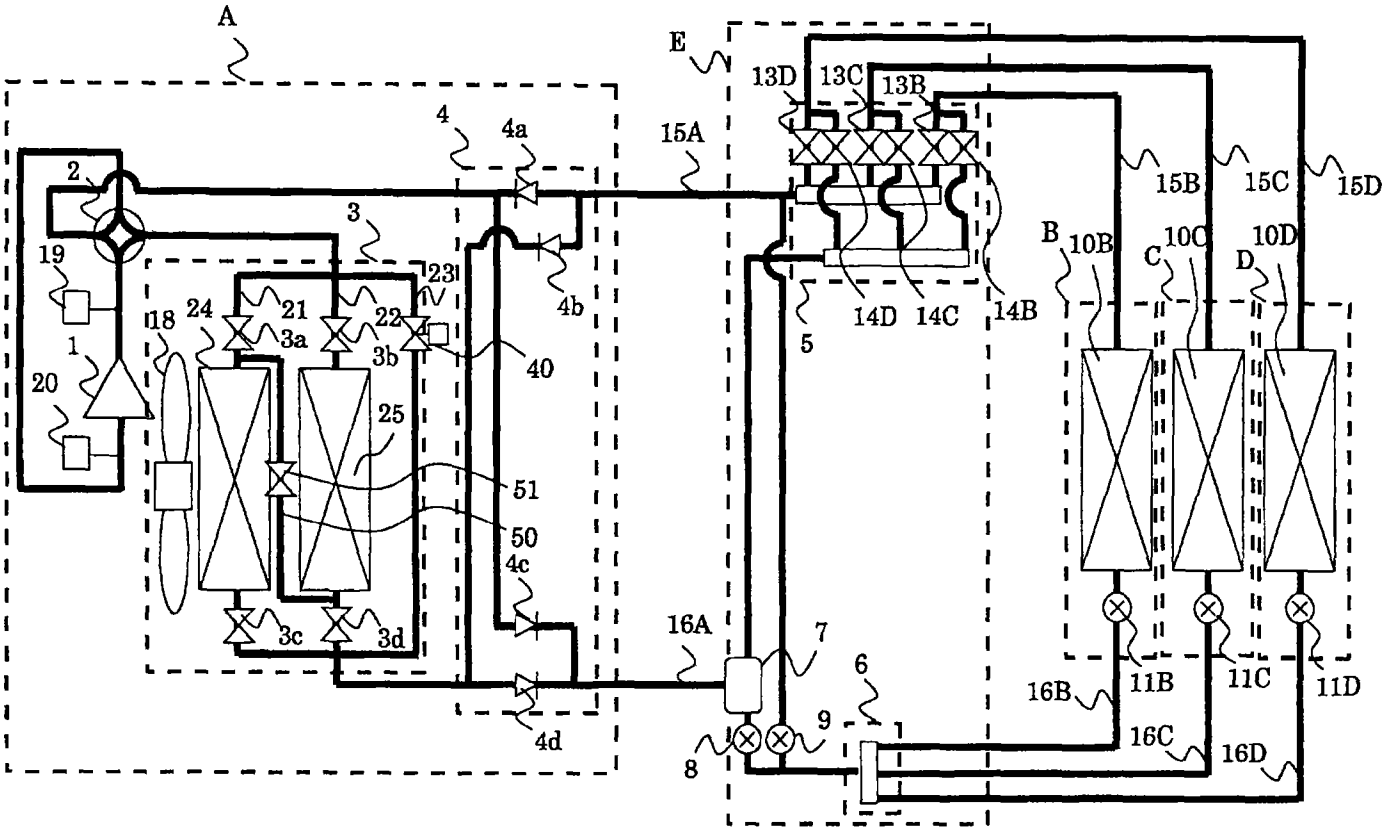
FIG. 9 is a diagram illustrating a refrigerant circuit of an air-conditioning apparatus as an example of a refrigeration cycle apparatus of Embodiment 2 of the invention.

FIG. 9 is a diagram illustrating a refrigerant circuit of an air-conditioning apparatus as an example of a refrigeration cycle apparatus of Embodiment 2 of the invention.

The air-conditioning apparatus according to Embodiment 2 is one with a bypass piping 50 and a solenoid valve 51 added to the configuration of the air-conditioning apparatus of Embodiment 1.

The bypass piping 50 serially connects the first heat exchanger 24 and the second heat exchanger 25. One end of this bypass piping 50 is connected to the second refrigerant circuit 22 between the second heat exchanger 25 and the solenoid valve 3*d*. Further, the other end of this bypass piping 50 is connected to the first refrigerant circuit 21 between the first heat exchanger 24 and the solenoid valve 3*a*. The solenoid valve 51 is provided in the bypass piping 50 and opens and closes the refrigerant passage of the bypass piping 50.

The bypass piping 50 corresponds to the connecting piping of the invention. Further, the solenoid valve 51 corresponds to the on-off device of the invention. Note that although in Embodiment 2, a device with a valve structure is employed as the on-off device, Embodiment 2 is not limited to the device. The structure of the on-off device may be any that can open/close the refrigerant passage of the bypass piping 50.

Next, the heat exchange capacity control method of the heat source side heat exchanger 3 will be described. In the air-conditioning apparatus according to Embodiment 2, the heat exchange capacity of the heat source side heat exchanger 3 is controlled in five stages when the heat source side heat exchanger 3 operates as a condenser (during the cooling only operation and the cooling main operation).

A first stage corresponds to a case in which the heat source side heat exchanger 3 is required to have the largest heat exchange capacity. The solenoid valves 3*b* and 3*c* are opened, the solenoid valves 3*a* and 3*d* and the flow control valve 40 are closed. Further, the solenoid valve 51 is opened. With the above, the refrigerant is distributed through the second heat exchanger 25 and the first heat exchanger 24 in this order and no refrigerant is distributed in the third refrigerant circuit 23. Further, the air volume of the air-sending device 18 is controlled by an inverter or the like (not illustrated) between minimum air volume and full speed.

Figure 10:
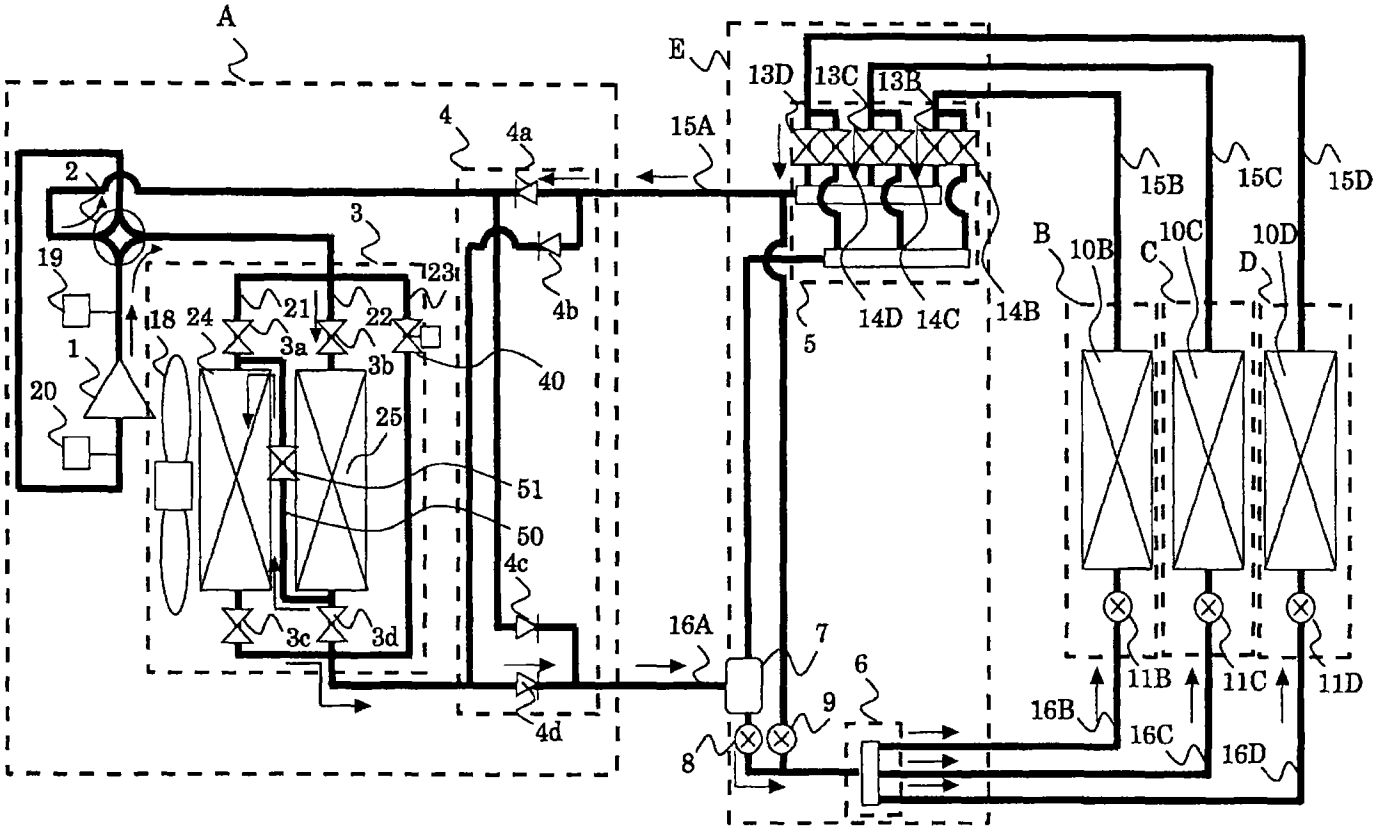
FIG. 10 is a diagram illustrating a flow of a refrigerant in a refrigerant circuit of an air-conditioning apparatus during a cooling only operation as an example of a refrigeration cycle apparatus of Embodiment 2 of the invention.

In FIG. 10, a refrigerant flow in the heat source side heat exchanger 3 during the cooling only operation is described as an example of the refrigerant flow in the heat source side heat exchanger 3 in the first stage.

A high-temperature high-pressure gas refrigerant that has been discharged from the compressor 1 flows into the four-way valve 2. The refrigerant that has flowed out of the four-way valve 2 flows into the heat source side heat exchanger 3. The high-temperature high-pressure gas refrigerant that has flowed into the heat source side heat exchanger 3 flows into the second heat exchanger 25, first. This refrigerant passes through the bypass piping 50 and flows into the first heat exchanger 24. Subsequently, the refrigerant that has flowed out of the first heat exchanger 24 passes through the fourth check valve 4*d* and flows into the second heat source unit side connecting piping 16A. The high-temperature high-pressure gas refrigerant that has flowed into the heat source side heat exchanger 3 exchanges heat with air sent by the air-sending device 18 and is condensed and liquefied in the course of flowing into the second heat exchanger 25 and flowing out of the first heat exchanger 24.

Note that the refrigerant flow after the second heat source unit side connecting piping 16A is the same as that described in Embodiment 1, and description will be omitted here.

In a case of the first stage, if there is outside wind, such as building-induced wind, even if the air-sending device 18 is set to its minimum air volume, a considerably large amount of heat will be exchanged. Further, if the heat source side heat exchanger 3 is a condenser, the condensing temperature drops, and if an evaporator, the evaporating temperature rises. Thus, the heat exchange capacity of the heat source side heat exchanger 3 is controlled with a similar control method as that of Embodiment 1 after the first stage. That is, the first stage to the fourth stage described in Embodiment 1 is a second stage to a fifth stage of Embodiment 2.

Figure 11:
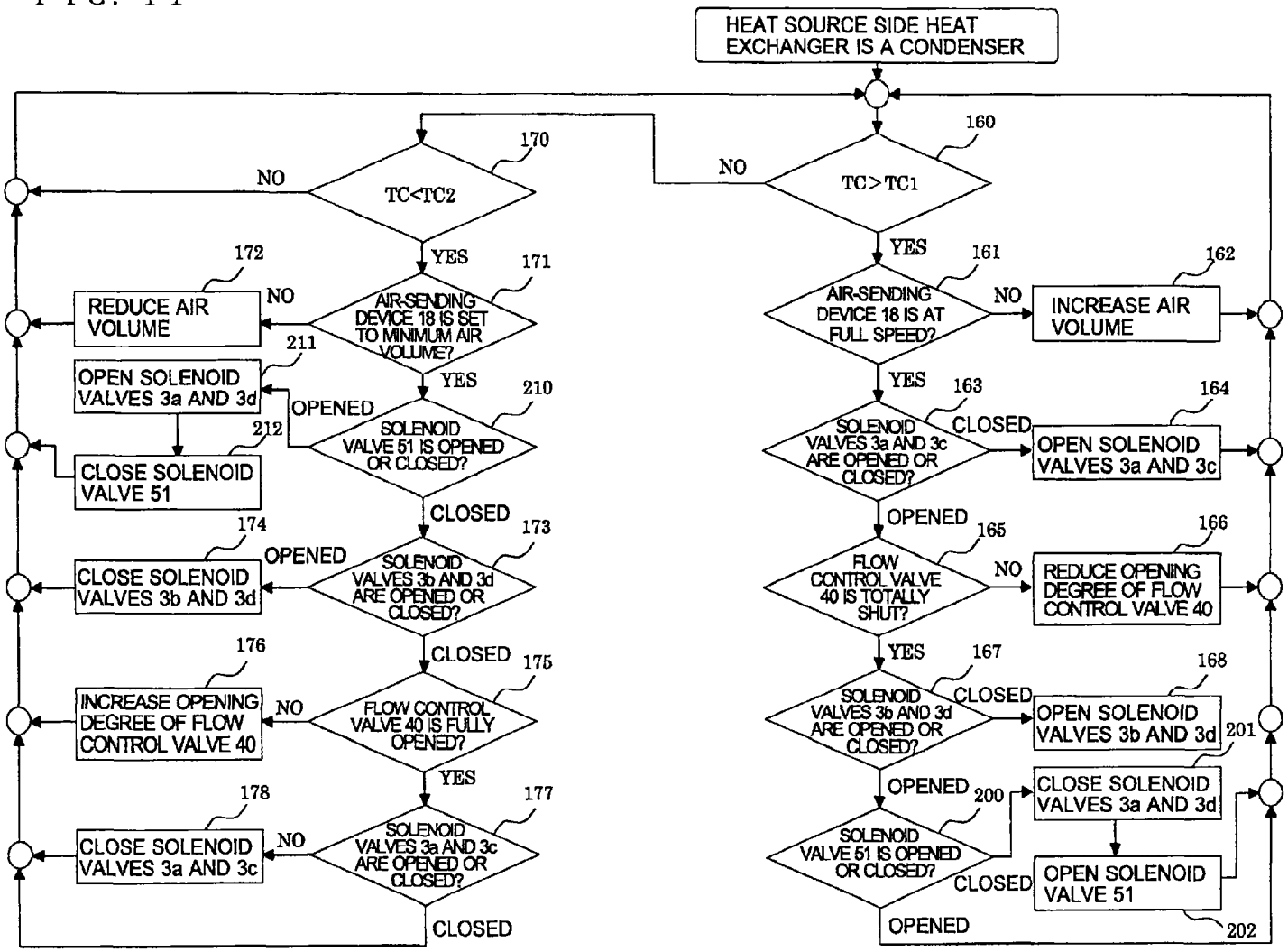
FIG. 11 is a diagram illustrating a control flow of a heat exchange capacity regulating device when the heat source side heat exchanger of an air-conditioning apparatus is functioning as a condenser as an example of a refrigeration cycle apparatus of Embodiment 2 of the invention.

In more detail, the control method of the heat exchange capacity of the heat source side heat exchanger 3 according to Embodiment 2 is as shown in FIG. 11.

FIG. 11 is a diagram illustrating a control flow of the heat exchange capacity regulating device when the heat source side heat exchanger of the air-conditioning apparatus is functioning as a condenser as an example of the refrigeration cycle apparatus of Embodiment 2 of the invention.

In step 160, (a detection temperature TC of the condensing temperature detection device 19) and (a prescribed first target condensing temperature TC1) are compared. If TC>TC1, control proceeds to step 161. In step 161, whether the air-sending device 18 is at full speed or not is determined. If the air-sending device 18 is not at full speed, the control proceeds to step 162 and increases the air volume, and then returns to step 160. If the air-sending device 18 is at full speed, in step 163, the opening/closing of each of the solenoid valves 3*a* and 3*c* is determined. If the solenoid valves 3*a* and 3*c* are closed, in step 164, the solenoid valves 3*a* and 3*c* are opened to open the first refrigerant circuit 21, that is, the first heat exchanger 24, and then the control returns to step 160. If the solenoid valves 3*a* and 3*c* are opened, the control proceeds to step 165.

In step 165, the opening degree of the flow control valve 40 is determined. If the flow control valve 40 is not totally closed, in step 166, the opening degree of the flow control valve 40 is reduced, and then the control returns to step 160. If the opening degree of the flow control valve 40 is totally closed, the control proceeds to step 167. In step 167, the opening/closing of each of the solenoid valves 3*b* and 3*d* is determined. If the solenoid valves 3*b* and 3*d* are closed, in step 168, the solenoid valves 3*b* and 3*d* are opened to open the second refrigerant circuit 22, that is, the second heat exchanger 25, and then the control returns to step 160. If the solenoid valves 3*b* and 3*d* are opened, the control proceeds to step 200.

In step 200, the opening/closing of the solenoid valve 51 is determined. If the solenoid valve 51 is closed, in step 201, the solenoid valves 3*a* and 3*d* are closed, and in step 202, the solenoid valve 51 is opened, and then the control returns to step 160. That is, the refrigerant passage is opened so that the second heat exchanger 25 and the first heat exchanger 24 are serially connected, and the control returns to step 160. If the solenoid valve 51 is opened, the control also returns to step 160.

On the other hand, if TC≤TC1 is determined in step 160, the control proceeds to step 170. In step 170, (a detection temperature TC of the condensing temperature detection device 19) and (a prescribed second target condensing temperature TC2 that is set smaller than the first target condensing temperature) are compared. If TC<TC2, the control proceeds to step 171, and if TC≥TC2, the control returns to step 160. In step 171, whether the air-sending device 18 is set to minimum air volume or not is determined. If the air-sending device 18 is not set to minimum air volume, the control proceeds to step 172 and decreases the air volume, and then returns to step 160. If the air-sending device 18 is set to minimum air volume, the control proceeds to step 210.

In step 210, the opening/closing of the solenoid valve 51 is determined. If the solenoid valve 51 is opened, in step 211, the solenoid valves 3*a* and 3*d* are opened, and in step 212, the solenoid valve 51 is closed, and then the control returns to step 160. That is, the refrigerant passage is opened so that the second heat exchanger 25 and the first heat exchanger 24 are parallelly connected, and the control returns to step 160. If the solenoid valve 51 is closed, the control proceeds to step 173.

In step 173, the opening/closing of each of the solenoid valves 3*b* and 3*d* is determined. If the solenoid valves 3*b* and 3*d* are opened, in step 174, the solenoid valves 3*b* and 3*d* are closed to close the second refrigerant circuit 22, that is, the second heat exchanger 25, and then the control returns to step 160. If the solenoid valves 3*b* and 3*d* are closed, the control proceeds to step 175.

In step 175, the opening degree of the flow control valve 40 is determined. If the flow control valve 40 is not fully opened, in step 176, the opening degree of the flow control valve 40 is increased, and then the control returns to step 160. If the opening degree of the flow control valve 40 is fully opened, the control proceeds to step 177. In step 177, the opening/closing of each of the solenoid valves 3*a* and 3*c* is determined. If the solenoid valves 3*a* and 3*c* are opened, in step 178, the solenoid valves 3*a* and 3*c* are closed to close the first refrigerant circuit 21, that is, the first heat exchanger 24, and then the control returns to step 160. In step 177, if the solenoid valves 3*a* and 3*c* are closed, the control also returns to step 160.

With the above, the detection temperature TC of the condensing temperature detection device 19 can be controlled to a temperature between the first target condensing temperature TC1 and the second target condensing temperature TC2.

Note that when the heat source side heat exchanger 3 operates as an evaporator (during the heating only operation and the heating main operation), the solenoid valve 51 is closed and the heat exchange capacity of the heat source side heat exchanger 3 is controlled with a similar method as that of Embodiment 1.

In the air-conditioning apparatus configured as above, the heat source side heat exchanger 3 operates as a condenser, and even with a flow of a high-pressure high-density refrigerant, by connecting the first heat exchanger 24 and the second heat exchanger 25 in series, the cross-sectional area of the passage of the refrigerant can be made small compared to when the first heat exchanger 24 and the second heat exchanger 25 is connected in parallel. Accordingly, the drop of flow velocity of the refrigerant flowing in the heat source side heat exchanger 3 can be suppressed. Thus, the heat transfer coefficient of the refrigerant (the heat exchange efficiency of the heat source side heat exchanger 3) is increased when the heat source side heat exchanger 3 is used as a condenser.

Furthermore, when the density of the refrigerant flowing in the heat source side heat exchanger 3 is low, that is, when the heat source side heat exchanger is operated as a condenser, by connecting the first heat exchanger 24 and the second heat exchanger 25 in parallel, the increase of flow velocity of the refrigerant flowing in the heat source side heat exchanger 3 can be suppressed. Accordingly, the pressure loss of the refrigerant flowing in the heat source side heat exchanger 3 can be reduced.

Hence, the efficiency of the air-conditioning apparatus is further improved.

In addition, in the air-conditioning apparatus configured as above, air sent from the air-sending device flows into the second heat exchanger 25 that is on the upstream side in the refrigerant flow direction after flowing into the first heat exchanger 24 that is on the downstream side in the refrigerant flow direction. Accordingly, the air that has exchanged heat in the first heat exchanger 24 and that has increased its temperature exchanges heat with the high-temperature refrigerant that has flowed into the second heat exchanger 25 from the compressor 1. Thus, the heat transfer efficiency of the heat source side heat exchanger 3 is improved and the efficiency of the air-conditioning apparatus is improved.

Embodiment 3

Considering the effect of the toxicity of the refrigerant on the human body and its flammability, an acceptable concentration of refrigerant leakage in a space such as an indoor space is stipulated under an international standard. For example, each of the acceptable concentration of refrigerant leakage in a space is determined as 0.44 kg/m$^3$ for R410A, which is a fluorocarbon refrigerant, 0.07 kg/m$^3$ for $CO_2$, and 0.008 kg/m$^3$ for propane.

In order to prevent such refrigerants leaking into indoor spaces, water, antifreeze, and the like may be preferably distributed to indoor heat exchangers. Accordingly, it will be effective to embody the invention in an air-conditioning apparatus that distributes water, antifreeze, and the like to indoor heat exchangers. Note that in Embodiment 3, elements not stated in particular is the same as Embodiments 1 or 2.

Figure 12:
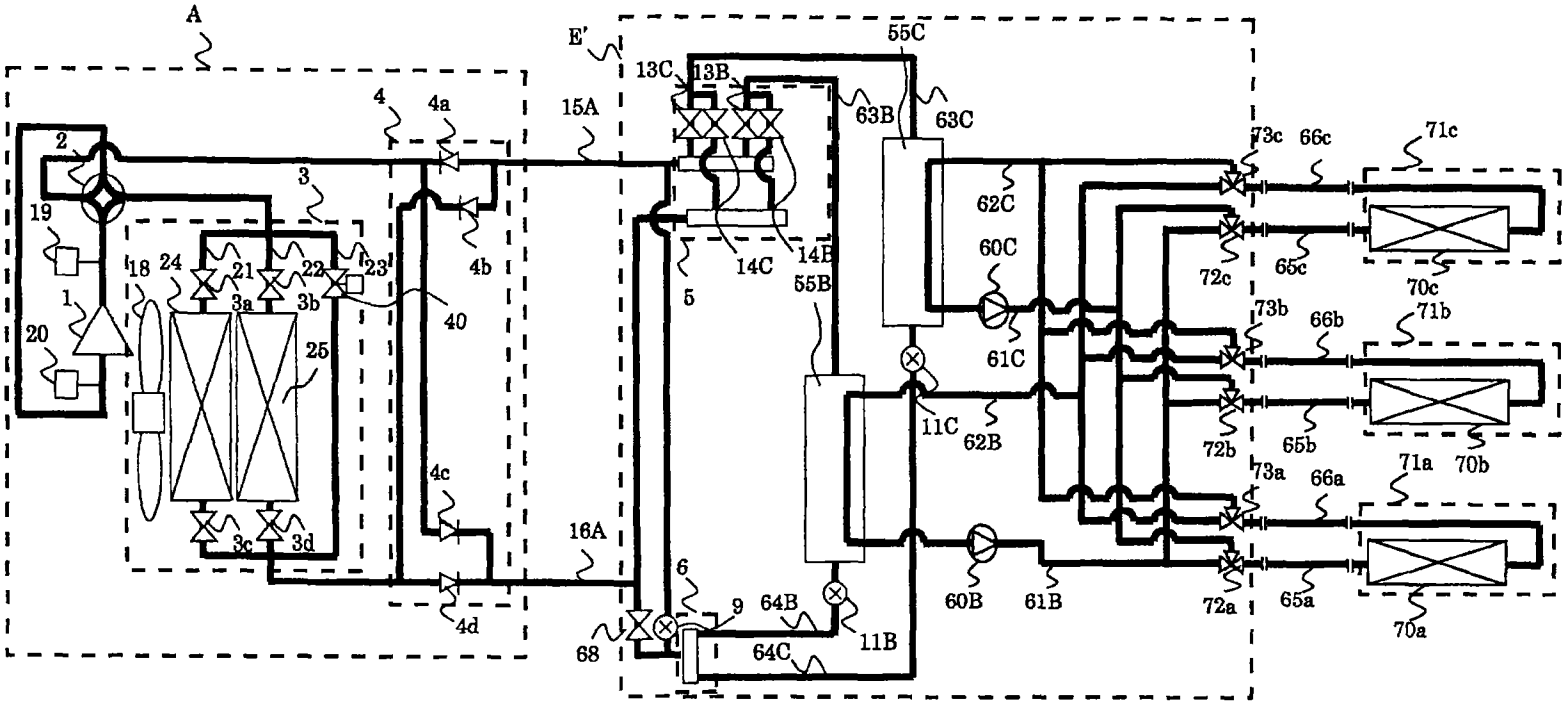
FIG. 12 is a diagram illustrating a refrigerant circuit of an air-conditioning apparatus as an example of a refrigeration cycle apparatus of Embodiment 3 of the invention.

FIG. 12 is a diagram illustrating a refrigerant circuit of an air-conditioning apparatus as an example of a refrigeration cycle apparatus of Embodiment 3 of the invention.

The air-conditioning apparatus according to Embodiment 3 is an air-conditioning apparatus in which water is distributed to the indoor heat exchangers. Further, this air-conditioning apparatus is a multi-room air-conditioning system connecting a plurality of indoor units to a single heat source unit. This air-conditioning apparatus includes the heat source unit A, a relay unit E', and a plurality of indoor units 71. In Embodiment 3, the air-conditioning apparatus includes three indoor units 71*a*, 71*b*, and 71*c*.

(Heat Source Unit A)

Same as Embodiment 1, the heat source unit A includes the compressor 1, the four-way valve 2, the heat source side heat exchanger 3, the air-sending device 18, which is capable of variably controlling the volume of air and which sends air to the heat source side heat exchanger 3, and the switching valve 4 that switches the passage of the refrigerant discharged from the compressor 1.

In the heat source unit A according to Embodiment 3, the fourth check valve 4*d* is connected to a refrigerant piping between the first branching unit 5 and a solenoid valve 68 in the relay unit E' to be described below via the second heat source unit side connecting piping 16A. Further, the first check valve 4*a* is connected to the first branching unit 5 of the relay unit E' to be described below via the first heat source unit side connecting piping 15A.

(Indoor Units 71)

The indoor units 71*a*, 71*b*, and 71*c* each have the same configuration.

In more detail, the indoor unit 71*a* includes an indoor side heat exchanger 70*a*. One end of the indoor side heat exchanger 70*a* is connected to a first water switching valve 72*a* of the relay unit E' to be described below via a third water piping 65*a*. The other end of the indoor side heat exchanger 70*a* is connected to the second water switching valve 73*a* of the relay unit E' to be described below via a fourth water piping 66*a*.

The indoor unit 71*a* includes an indoor side heat exchanger 70*b*. One end of the indoor side heat exchanger 70*b* is connected to a first water switching valve 72*b* of the relay unit E' to be described below via a third water piping 65*b*. The other end of the indoor side heat exchanger 70*b* is connected to the second water switching valve 73*b* of the relay unit E' to be described below via a fourth water piping 66*b*.

The indoor unit 71*c* includes an indoor side heat exchanger 70*c*. One end of the indoor side heat exchanger 70*c* is connected to a first water switching valve 72*c* of the relay unit E' to be described below via a third water piping 65*c*. The other end of the indoor side heat exchanger 70*c* is connected to the second water switching valve 73*c* of the relay unit E' to be described below via a fourth water piping 66*c*.

(Relay Unit E')

The relay unit E' includes the first branching unit 5, the second branching unit 6, the flow control valve 9, a first water-to-refrigerant heat exchanger 55B, a second water-to-refrigerant heat exchanger 55C, a plurality of first water switching valves 72 (the first water switching valves 72*a*, 72*b*, and 72*c*), a plurality of second water switching valves 73 (the second water switching valves 73*a*, 73*b*, and 73*c*), a plurality of pumps 60 (pumps 60A and 60B), and the solenoid valve 68.

The first branching unit 5 includes solenoid valves 13B and 13C and the solenoid valves 14B and 14C.

One end of each of the solenoid valves 13B and 13C is connected to the first heat source unit side connecting piping 15A. Further, the other end of solenoid valve 13B is connected to the first water-to-refrigerant heat exchanger 55B via a first water-to-refrigerant heat exchanger connecting piping 63B. The other end of solenoid valve 13C is connected to the second water-to-refrigerant heat exchanger 55C via a first water-to-refrigerant heat exchanger connecting piping 63C.

One end of each of the solenoid valves 14B and 14C is connected to the second branching unit 6. Further, the other end of solenoid valve 14B is connected to the first heat source unit side connecting piping 15A via a first water-to-refrigerant heat exchanger connecting piping 63B. The other end of solenoid valve 14C is connected to the second water-to-refrigerant heat exchanger 55C via a first water-to-refrigerant heat exchanger connecting piping 63C.

The solenoid valve 68 is provided in the refrigerant piping between the solenoid valves 14B and 14C and the second branching unit 6, and the second heat source unit side connecting piping 16A is connected to this piping between the solenoid valves 14B and 14C and the solenoid valve 68.

The second branching unit 6 branchingly connects second water-to-refrigerant heat exchanger connecting pipings 64B and 64C to the second heat source unit side connecting piping 16A. This second water-to-refrigerant heat exchanger connecting piping 64B is connected to the first water-to-refrigerant heat exchanger 55B and a flow control valve 11B is provided in the second water-to-refrigerant heat exchanger connecting piping 64B. Further, the second water-to-refrigerant heat exchanger connecting piping 64*c* is connected to the second water-to-refrigerant heat exchanger 55C and a flow control valve 11C is provided in the second water-to-refrigerant heat exchanger connecting piping 64C.

The flow control valve 9 is connected between the second branching unit 6 and the first heat source unit side connecting piping 15A.

The first water-to-refrigerant heat exchanger 55B exchanges heat between the refrigerant flowing in the heat source side refrigerant circuit on the heat source unit A side and water flowing in the use side refrigerant circuit on the indoor units 71 side. In this first water-to-refrigerant heat exchanger 55B, as described above, the first water-to-refrigerant heat exchanger connecting piping 63B and the second water-to-refrigerant heat exchanger connecting piping 64B is connected as the heat source side refrigerant circuit. Further, in this first water-to-refrigerant heat exchanger 55B, a first water piping 61B and a second water piping 62B is connected as the use side refrigerant circuit.

Furthermore, the first water piping 61B is also connected to the second water switching valves 73*a*, 73*b*, and 73*c*. The second water piping 62B is connected to the second water switching valves 73*a*, 73*b*, and 73*c*.

The pump 60*b* that circulates the water in the use side refrigerant circuit is provided to the first water piping 61B.

The second water-to-refrigerant heat exchanger 55C exchanges heat between the refrigerant flowing in the heat source side refrigerant circuit on the heat source unit A side and water flowing in the use side refrigerant circuit on the indoor units 71 side. In this first water-to-refrigerant heat exchanger 55C, as described above, the first water-to-refrigerant heat exchanger connecting piping 63C and the second water-to-refrigerant heat exchanger connecting piping 64C is connected as the heat source side refrigerant circuit. Further, in this first water-to-refrigerant heat exchanger 55C, a first water piping 61C and a second water piping 62C is connected as the use side refrigerant circuit.

Furthermore, the first water piping 61C is also connected to the first water switching valves 72*a*, 72*b*, and 72*c*. The second water piping 62C is connected to the second water switching valves 73*a*, 73*b*, and 73*c*.

The pump 60C that circulates the water in the use side refrigerant circuit is provided to the first water piping 61C.

<Flow of Refrigerant>

Figure 13:
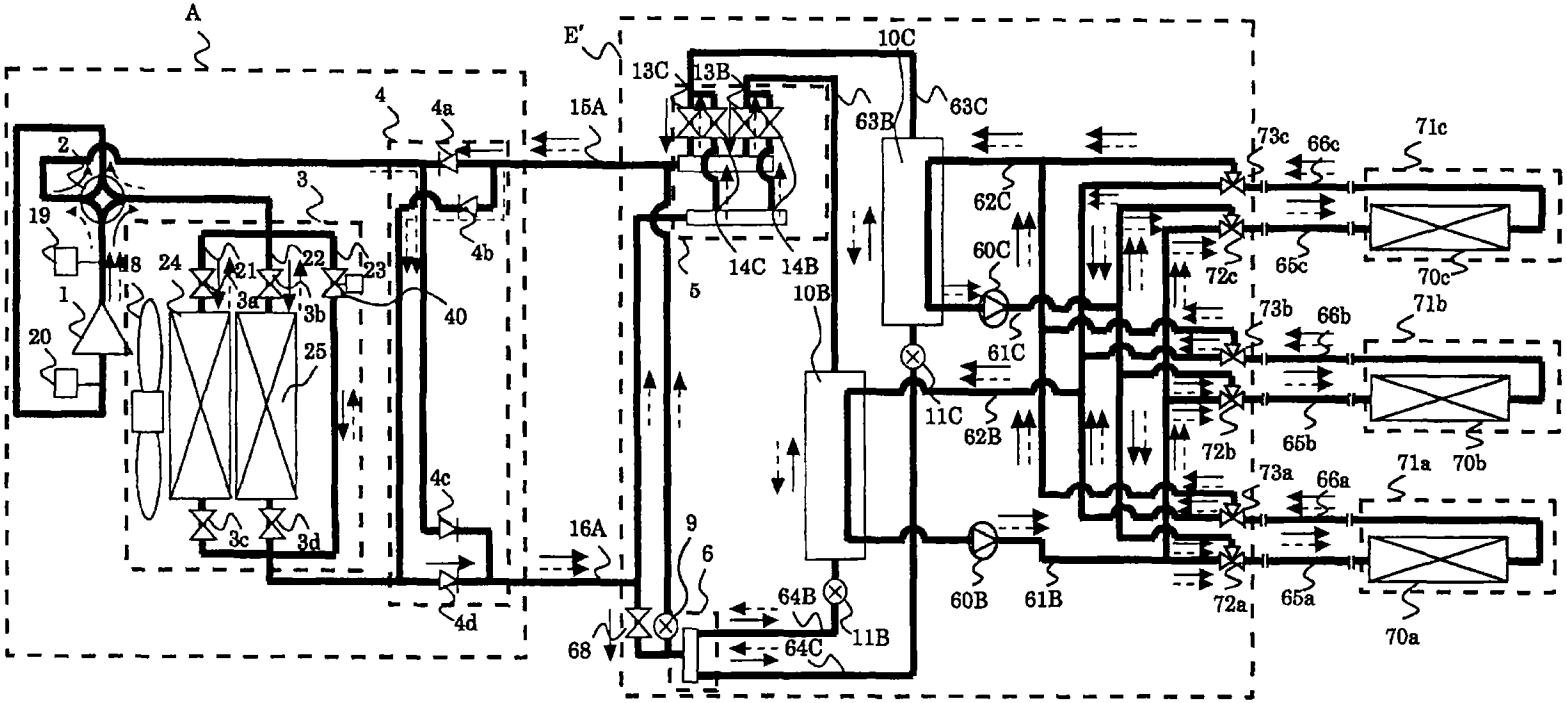
FIG. 13 is a diagram illustrating flows of a refrigerant in a refrigerant circuit of an air-conditioning apparatus during a cooling operation and a heating operation as an example of a refrigeration cycle apparatus of Embodiment 3 of the invention.
Figure 14:
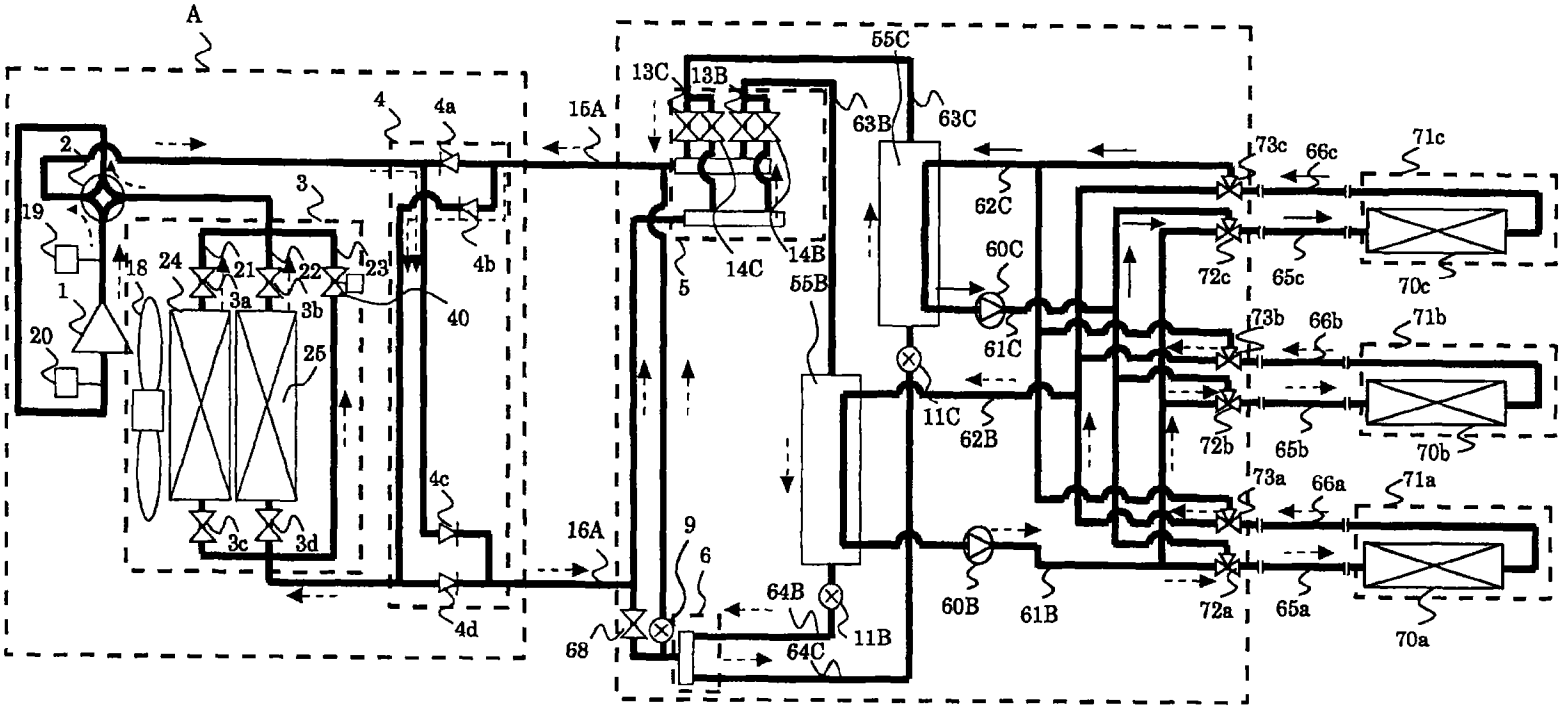
FIG. 14 is a diagram illustrating flows of a refrigerant in a refrigerant circuit of an air-conditioning apparatus during a heating main operation as an example of a refrigeration cycle apparatus of Embodiment 3 of the invention.
Figure 15:
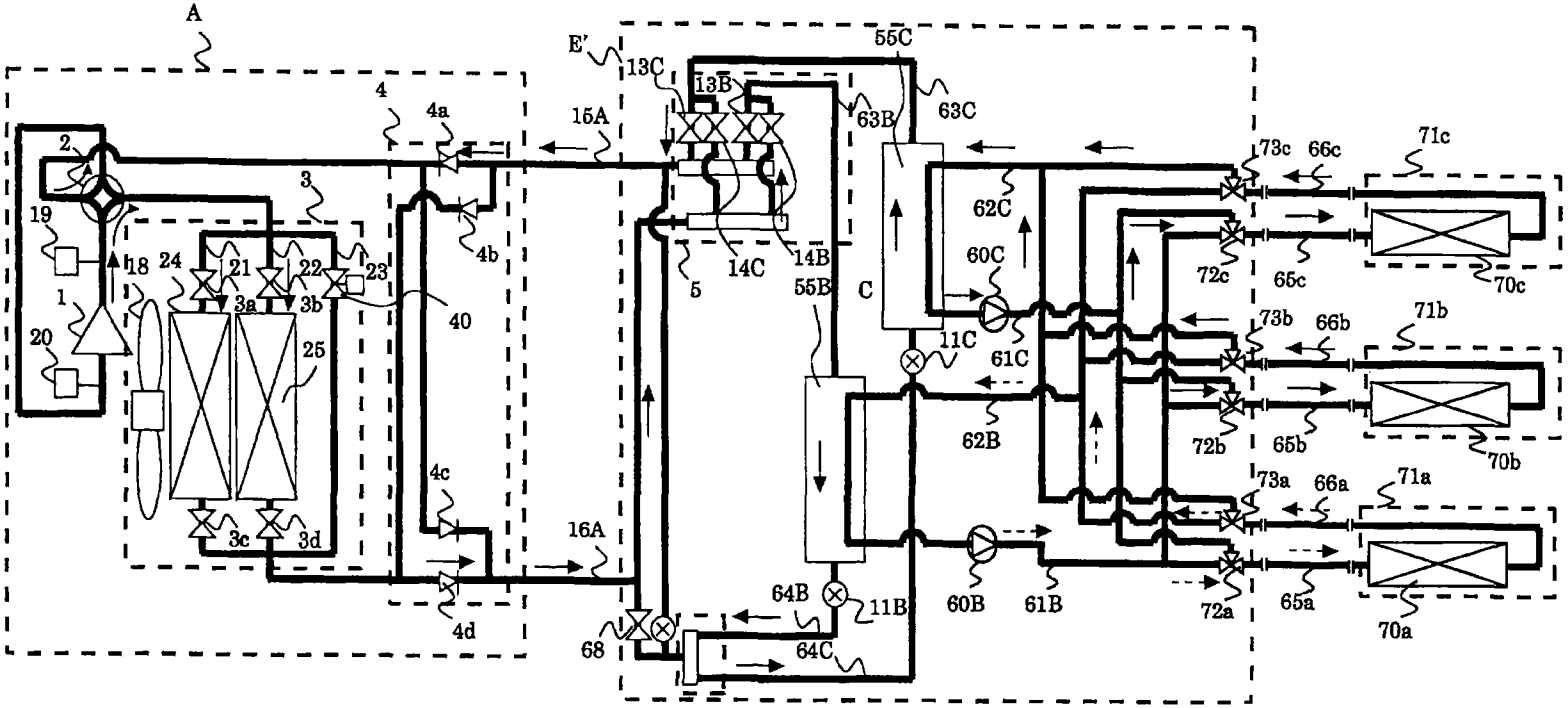
FIG. 15 is a diagram illustrating flows of a refrigerant in a refrigerant circuit of an air-conditioning apparatus during a cooling main operation as an example of a refrigeration cycle apparatus of Embodiment 3 of the invention.

The flow of the refrigerant of the air-conditioning apparatus according to Embodiment 3 will be subsequently described with reference to FIGS. 13, 14, and 15. In FIG. 13, the refrigerant flows during the cooling only operation and the refrigerant flow during the heating only operation will be described. In FIG. 14, the refrigerant flow during the heating main operation will be described. In FIG. 15, the refrigerant flow during the cooling main operation will be described.

(Flow of Refrigerant During Cooling Only Operation)

FIG. 13 is a diagram illustrating flows of the refrigerant in the refrigerant circuit of the air-conditioning apparatus during the cooling operation and the heating operation as an example of the refrigeration cycle apparatus of Embodiment 3 of the invention.

First, the flow of the refrigerant flowing in the heat source side refrigerant circuit on the heat source unit A side will be described. The direction of the solid arrows in FIG. 13 indicates the direction of the refrigerant flow during the cooling only operation.

A high-temperature high-pressure gas refrigerant that has been discharged from the compressor 1 flows into the four-way valve 2. The refrigerant that has flowed out of the four-way valve 2 flows into the heat source side heat exchanger 3. The refrigerant that has flowed into the heat source side heat exchanger 3 exchanges heat with the air sent by the air-sending device 18 and is condensed and liquefied. The condensed and liquefied, high-pressure liquid refrigerant flows through the fourth check valve 4*d*, passes through the second heat source unit side connecting piping 16A, and the solenoid valve 68 in this order, and flows into the second branching unit 6. The high-pressure liquid refrigerant that has flowed into the second branching unit 6 passes through the second water-to-refrigerant heat exchanger connecting pipings 64B and 64C and flows into each of the respective flow control valves 11B and 11C.

This refrigerant is decompressed to low pressure by the flow control valves 11B and 11C that are controlled based on the amount of superheat in the corresponding outlets of the first water-to-refrigerant heat exchanger 55B and the second water-to-refrigerant heat exchanger 55C. The refrigerant exchanges heat with water in the water-to-refrigerant heat exchangers 55B and 55C and is evaporated and gasified to cool the water. Then, this refrigerant that has turned into a gaseous state passes through the first water-to-refrigerant heat exchanger connecting pipings 63B and 63C, the solenoid valves 13B and 13C, the first branching unit 5, the first heat source unit side connecting piping 15A, the first check valve 4*a*, and the four-way valve 2, and is sucked into the compressor 1.

During the cooling only operation, the solenoid valve 68 is opened, the solenoid valves 13B and 13C are opened, the solenoid valves 14B and 14C are closed. Accordingly, the refrigerant flows in the direction of the solid arrows in the first water-to-refrigerant heat exchanger connecting pipings 63B and 63C, the second water-to-refrigerant heat exchanger connecting pipings 64B and 64C, the first water-to-refrigerant heat exchanger 55B and the second water-to-refrigerant heat exchanger 55C. Further, since the first heat source unit side connecting piping 15A is low in pressure, the second heat source unit side connecting piping 16A is high in pressure, the end connection of the heat source side heat exchanger 3 to the switching valve 4 is high in pressure, and the end connection of the four-way valve 2 to the switching valve 4 is low in pressure, the refrigerant inevitably flows to the first check valve 4*a* and the fourth check valve 4*d*.

Next, the flow of water flowing in the use side refrigerant circuit on the indoor units 71 side will be described. The direction of the solid arrows in FIG. 13 indicates the direction of the water flow during the cooling only operation.

Water that has been cooled in the first water-to-refrigerant heat exchanger 55B and second water-to-refrigerant heat exchanger 55C is pressurized in the respective pumps 60B and 60C, passes through the corresponding first water pipings 61B and 61C, and is merged in each of the first water switching valves 72*a*, 72*b*, and 72*c*. The water that has been merged in the first water switching valves 72*a*, 72*b*, and 72*c* passes through the third water pipings 65*a*, 65*b*, and 65*c* and flows into the indoor units 71*a*, 71*b*, and 71*c*, respectively. The water that has flowed into the indoor units 71*a*, 71*b*, and 71*c* increases its temperature while cooling the indoor air in the respective indoor side heat exchangers 70*a*, 70*b*, and 70*c*. The water that has been heated in the indoor side heat exchangers 70*a*, 70*b*, and 70*c* passes through the fourth water pipings 66*a*, 66*b*, and 66*c* and flows into the second water switching valves 73*a*, 73*b*, and 73*c*, respectively. The water that has flowed into the second water switching valves 73*a*, 73*b*, and 73*c* is each branched to the second water piping 62B and the second water piping 62C and returns to the first water-to-refrigerant heat exchanger 55B and the second water-to-refrigerant heat exchanger 55C, respectively.

(Flow of Refrigerant During Heating Only Operation)

First, the flow of the refrigerant flowing in the heat source side refrigerant circuit on the heat source unit A side will be described. The direction of the broken-line arrows in FIG. 13 indicates the direction of the refrigerant flow during the heating only operation.

A high-temperature high-pressure gas refrigerant that has been discharged from the compressor 1 flows into the four-way valve 2. The refrigerant that has flowed out of the four-way valve 2, passes through the third check valve 4*c*, the second heat source unit side connecting piping 16A, and flows into the first branching unit 5. The high-temperature high-pressure gas refrigerant that has flowed into the first branching unit 5 passes through each of the solenoid valves 14B and 14C and the corresponding first water-to-refrigerant heat exchanger connecting pipings 63B and 63C in this order and flows into the first water-to-refrigerant heat exchanger 55B and the second water-to-refrigerant heat exchanger 55C. Further, the high-temperature high-pressure gas refrigerant that has flowed into the first water-to-refrigerant heat exchanger 55B and the second water-to-refrigerant heat exchanger 55C exchanges heat with water and is condensed and liquefied to heat the water.

This refrigerant in a liquid state passes through the nearly fully opened flow control valves 11B and 11C that are controlled based on the amount of subcooling in each of the respective outlet of the first water-to-refrigerant heat exchanger 55B and the second water-to-refrigerant heat exchanger 55C and flows into the respective second water-to-refrigerant heat exchanger connecting pipings 64B and 64C. The refrigerant flows into the second branching unit 6 and is merged, and, further, passes through the third flow control valve 9. The refrigerant is decompressed into a low-pressure two-phase gas-liquid state in either of the flow control valves 11B and 11C or the third flow control valve 9. Further, the refrigerant that has been decompressed to low pressure passes through the first heat source unit side connecting piping 15A and the second check valve 4*b* of the heat source unit A and flows into the heat source side heat exchanger 3. The refrigerant that has flowed into the heat source side heat exchanger 3 exchanges heat with the air sent by the air-sending device 18, which is capable of variably controlling the volume of air, and is evaporated and gasified. The refrigerant that has turned into a gaseous state passes through the four-way valve 2 of the heat source unit and is sucked into the compressor 1.

During the heating only operation, the solenoid 68 is closed, the solenoid valves 14B and 14C are opened, the solenoid valves 13B and 13C are closed. Accordingly, the refrigerant flows in the direction of the broken-line arrows in the first water-to-refrigerant heat exchanger connecting pipings 63B and 63C, the second water-to-refrigerant heat exchanger connecting pipings 64B and 64C, the first water-to-refrigerant heat exchanger 55B and the second water-to-refrigerant heat exchanger 55C. Further, since the first heat source unit side connecting piping 15A is low in pressure, the second heat source unit side connecting piping 16A is high in pressure, the end connection of the heat source side heat exchanger 3 to the switching valve 4 is low in pressure, and the end connection of the four-way valve 2 to the switching valve 4 is high in pressure, the refrigerant inevitably flows to the second check valve 4*b* and the third check valve 4*c*.

Next, the flow of water flowing in the use side refrigerant circuit on the indoor units 71 side will be described. The direction of the broken-line arrows in FIG. 13 indicates the direction of the water flow during the heating only operation.

Water that has been heated in the first water-to-refrigerant heat exchanger 55B and second water-to-refrigerant heat exchanger 55C is pressurized in the respective pumps 60B and 60C, passes through the corresponding first water pipings 61B and 61C, and is merged in each of the first water switching valves 72*a*, 72*b*, and 72*c*. The water that has been merged in the first water switching valves 72*a*, 72*b*, and 72*c* passes through the third water pipings 65*a*, 65*b*, and 65*c* and flows into the indoor units 71*a*, 71*b*, and 71*c*, respectively. The water that has flowed into the indoor units 71*a*, 71*b*, and 71*c* reduces its temperature while heating the indoor air in the respective indoor side heat exchangers 70*a*, 70*b*, and 70*c*. The water that has reduced its temperature in the indoor side heat exchangers 70*a*, 70*b*, and 70*c* passes through the fourth water pipings 66*a*, 66*b*, and 66*c* and flows into the second water switching valves 73*a*, 73*b*, and 73*c*, respectively. The water that has flowed into the second water switching valves 73*a*, 73*b*, and 73*c* is each branched to the second water piping 62B and the second water piping 62C and returns to the first water-to-refrigerant heat exchanger 55B and the second water-to-refrigerant heat exchanger 55C, respectively.

(Flow of Refrigerant During Heating Main Operation)

FIG. 14 is a diagram illustrating flows of the refrigerant in the refrigerant circuit of the air-conditioning apparatus during the heating main operation as an example of the refrigeration cycle apparatus of Embodiment 3 of the invention. Note that in FIG. 14, a case in which the indoor units 71*a* and 71*b* carry out heating operation and the indoor unit 71*c* carries out cooling operation is illustrated. Further, during the heating main operation, the heat source side heat exchanger 3 functions as an evaporator, the first water-to-refrigerant heat exchanger 55B functions as a condenser, and the second water-to-refrigerant heat exchanger 55C functions as an evaporator.

First, the flow of the refrigerant flowing in the heat source side refrigerant circuit on the heat source unit A side will be described. The direction of the broken-line arrows in FIG. 14 indicates the direction of the refrigerant flow during the heating main operation.

A high-temperature high-pressure gas refrigerant that has been discharged from the compressor 1 flows into the four-way valve 2. The refrigerant that has flowed out of the four-way valve 2, passes through the third check valve 4*c*, the second heat source unit side connecting piping 16A, and flows into the first branching unit 5 of the relay unit E'. The high-temperature high-pressure gas refrigerant that has flowed into the first branching unit 5 passes through the solenoid valve 14B and the first water-to-refrigerant heat exchanger connecting piping 63B in this order and flows into the first water-to-refrigerant heat exchanger 55B. Further, the high-temperature high-pressure gas refrigerant that has flowed into the first water-to-refrigerant heat exchanger 55B exchanges heat with water and is condensed and liquefied to heat the water. This refrigerant that has turned into a liquid state passes through the flow control valve 11B whose opening degree, which has been controlled on the basis of the amount of subcooling at the outlet of the first water-to-refrigerant heat exchanger 55B, is in a nearly fully opened state, is slightly decompressed, and flows into the second branching unit 6 through the second water-to-refrigerant heat exchanger connecting piping 64B.

A portion of the refrigerant that has flowed into the second branching unit 6 passes through the second water-to-refrigerant heat exchanger connecting piping 64C and flows into the second water-to-refrigerant heat exchanger 55C that is about to cool water. This refrigerant enters the flow control valve 11C that is controlled by the amount of superheat in the outlet of the second water-to-refrigerant heat exchanger 55C and is decompressed. The decompressed refrigerant exchanges heat in the second water-to-refrigerant heat exchanger 55C and is evaporated and gasified to cool the water. This refrigerant that has turned into a gaseous state passes through the solenoid valve 13C and flows into the first heat source unit side connecting piping 15A.

Meanwhile, the remaining refrigerant in the second branching unit 6 passes through the third flow control valve 9 that is controlled such that the pressure difference between the high pressure (for example, the pressure of the second heat source unit side connecting piping 16A) and the middle pressure (for example, the pressures of the second water-to-refrigerant heat exchanger connecting pipings 64B and 64C) is within a predetermined range. Subsequently, this refrigerant merges in the first heat source unit side connecting piping 15A with the refrigerant that has passed through the second water-to-refrigerant heat exchanger 55C.

The refrigerant that has been merged in the first heat source unit side connecting piping 15A flows into the heat source unit A, passes through the second check valve 4*b*, and flows into the heat source side heat exchanger 3. Here, the refrigerant that has evaporated and has turned into a gaseous state after exchanging heat with the air sent from the air-sending device 18, which is capable of variably controlling the volume of air, flows through the four-way valve 2 of the heat source unit and is sucked into the compressor 1.

During the heating main operation, since the solenoid valve 68 is closed, the solenoid valve 14B is opened, and the solenoid valve 13B is closed, the refrigerant flows in the direction of the broken-line arrows in the first water-to-refrigerant heat exchanger connecting piping 63B, the first water-to-refrigerant heat exchanger 55B, and the second water-to-refrigerant heat exchanger connecting piping 64B, and heats the water. Further, since the solenoid valve 14C is closed and the solenoid valve 13C is opened, the refrigerant flows in the direction of the broken-line arrows in the first water-to-refrigerant heat exchanger connecting piping 63C, the second water-to-refrigerant heat exchanger 55C, and the second water-to-refrigerant heat exchanger connecting piping 64C, and cools the water. Further, since the first heat source unit side connecting piping 15A is low in pressure, the second heat source unit side connecting piping 16A is high in pressure, the end connection of the heat source side heat exchanger 3 to the switching valve 4 is low in pressure, and the end connection of the four-way valve 2 to the switching valve 4 is high in pressure, the refrigerant inevitably flows to the second check valve 4*b* and the third check valve 4*c*.

Next, the flow of water flowing in the use side refrigerant circuit on the indoor units 71 side will be described. The direction of the broken-line arrows in FIG. 14 indicate the direction of the flow of water that is used in the heating operation. The direction of the solid arrows in FIG. 14 indicates the direction of the flow of water that is used in the cooling operation.

Water that has been heated in the first water-to-refrigerant heat exchanger 55B is pressurized in the pump 60B, passes through the first water piping 61B, and flows into the first water switching valves 72*a* and 72*b*. The water that has flowed into the first water switching valves 72*a* and 72*b* passes through the third water pipings 65*a* and 65*b* and flows into the indoor units 71*a* and 71*b*, respectively. The water that has flowed into the indoor units 71*a* and 71*b* reduces its temperature while heating the indoor air in the respective indoor side heat exchangers 70*a* and 70*b*. The water that has reduced its temperature in the indoor side heat exchangers 70*a* and 70*b* passes through the fourth water pipings 66*a* and 66*b* and flows into the second water switching valves 73*a* and 73*b*, respectively. The water that has flowed into the second water switching valves 73*a* and 73*b* returns to the first water-to-refrigerant heat exchanger 55B.

Meanwhile, the water that has been heated in the second water-to-refrigerant heat exchanger 55C is pressurized in the pump 60C, passes through the first water piping 61C, and flows into the first water switching valve 72*c*. The water that has flowed into the first water switching valve 72*c* passes through the third water piping 65*c* and flows into the indoor unit 71*c*. The water that has flowed into the indoor unit 71*c* increases its temperature while cooling the indoor air in the indoor side heat exchanger 70*c*. The water that has been heated in the indoor side heat exchanger 70*c* passes through the fourth water piping 66*c* and flows into the second water switching valve 73*c*. The water that has flowed into the second water switching valve 73*c* returns to the second water-to-refrigerant heat exchanger 55C.

(Flow of Refrigerant During Cooling Main Operation)

FIG. 15 is a diagram illustrating flows of the refrigerant in the refrigerant circuit of the air-conditioning apparatus during the cooling main operation as an example of the refrigeration cycle apparatus of Embodiment 3 of the invention. Note that in FIG. 15, a case in which the indoor unit 71*a* carries out heating operation and the indoor units 71*b* and 71*c* carry out cooling operation is illustrated. Further, during the cooling main operation, the heat source side heat exchanger 3 functions as an condenser, the first water-to-refrigerant heat exchanger 55B functions as a condenser, and the second water-to-refrigerant heat exchanger 55C functions as an evaporator.

First, the flow of the refrigerant flowing in the heat source side refrigerant circuit on the heat source unit A side will be described. The direction of the solid arrows in FIG. 15 indicates the direction of the refrigerant flow during the cooling main operation.

A high-temperature high-pressure gas refrigerant that has been discharged from the compressor 1 flows into the four-way valve 2. The refrigerant that has flowed out of the four-way valve 2 flows into the heat source side heat exchanger 3. The refrigerant that has flowed into the heat source side heat exchanger 3 exchanges heat with the air sent by the air-sending device 18 and is moderately condensed and liquefied, and turns into a high-temperature high-pressure two-phase refrigerant. The high-temperature high-pressure two-phase refrigerant, passes through the fourth check valve 4*d*, the second heat source unit side connecting piping 16A, and flows into the first branching unit 5 of the relay unit E'. The high-temperature high-pressure two-phase refrigerant that has flowed into the first branching unit 5 passes through the solenoid valve 13B and the first water-to-refrigerant heat exchanger connecting piping 63B in this order and flows into the first water-to-refrigerant heat exchanger 55B. Further, the high-temperature high-pressure two-phase refrigerant that has flowed into the first water-to-refrigerant heat exchanger 55B exchanges heat with water and is condensed and liquefied to heat the water. This refrigerant that has turned into a liquid state passes through the flow control valve 11B whose opening degree, which has been controlled on the basis of the amount of subcooling at the outlet of the first water-to-refrigerant heat exchanger 55B, is in a nearly fully opened state, is slightly decompressed, and flows into the second branching unit 6 through the second water-to-refrigerant heat exchanger connecting piping 64B.

The refrigerant that has flowed into the second branching unit 6 passes through the second water-to-refrigerant heat exchanger connecting piping 64C and flows into the second water-to-refrigerant heat exchanger 55C that is about to cool water. This refrigerant enters the flow control valve 11C that is controlled by the amount of superheat in the outlet of the second water-to-refrigerant heat exchanger 55C and is decompressed to low pressure. The decompressed refrigerant exchanges heat in the second water-to-refrigerant heat exchanger 55C and is evaporated and gasified to cool the water. This refrigerant that has turned into a gaseous state passes through the first water-to-refrigerant heat exchanger connecting piping 63C, the solenoid valve 13C, the first branching unit 5, the first heat source unit side connecting piping 15A, the first check valve 4*a*, and the four-way valve 2, and is sucked into the compressor 1.

During the cooling main operation, since the solenoid valve 68 is closed, the solenoid valve 14B is opened, and the solenoid valve 13B is closed, the refrigerant flows in the direction of the solid arrows in the first water-to-refrigerant heat exchanger connecting piping 63B, the first water-to-refrigerant heat exchanger 55B, and the second water-to-refrigerant heat exchanger connecting piping 64B, and heats the water. Further, since the solenoid valve 14C is closed and the solenoid valve 13C is opened, the refrigerant flows in the direction of the solid arrows in the first water-to-refrigerant heat exchanger connecting piping 63C, the second water-to-refrigerant heat exchanger 55C, and the second water-to-refrigerant heat exchanger connecting piping 64C, and cools the water. Further, since the first heat source unit side connecting piping 15A is low in pressure, the second heat source unit side connecting piping 16A is high in pressure, the end connection of the heat source side heat exchanger 3 to the switching valve 4 is high in pressure, and the end connection of the four-way valve 2 to the switching valve 4 is low in pressure, the refrigerant inevitably flows to the first check valve 4*a* and the fourth check valve 4*d*.

Next, the flow of water flowing in the use side refrigerant circuit on the indoor units 71 side will be described. The direction of the broken-line arrows in FIG. 15 indicate the direction of the flow of water that is used in the heating operation. The direction of the solid arrows in FIG. 15 indicates the direction of the flow of water that is used in the cooling operation.

Water that has been heated in the first water-to-refrigerant heat exchanger 55B is pressurized in the pump 60B, passes through the first water piping 61B, and flows into the first water switching valve 72*a*. The water that has flowed into the first water switching valve 72*a* passes through the third water piping 65*a* and flows into the indoor unit 71*a*. The water that has flowed into the indoor unit 71*a* reduces its temperature while heating the indoor air in the indoor side heat exchanger 70*a*. The water that has reduced its temperature in the indoor side heat exchanger 70*a* passes through the fourth water piping 66*a* and flows into the second water switching valve 73*a*. The water that has flowed into the second water switching valve 73*a* returns to the first water-to-refrigerant heat exchanger 55B.

Meanwhile, the water that has been heated in the second water-to-refrigerant heat exchanger 55C is pressurized in the pump 60C, passes through the first water piping 61C, and flows into the first water switching valves 72*b* and 72*c*. The water that has flowed into the first water switching valves 72*b* and 72*c* passes through the third water pipings 65*b* and 65*c* and flows into the indoor units 71*b* and 71*c*, respectively. The water that has flowed into the indoor units 71*b* and 71*c* increases its temperature while cooling the indoor air in the respective indoor side heat exchangers 70*b* and 70*c*. The water that has been heated in the indoor side heat exchangers 70*b* and 70*c* passes through the fourth water pipings 66*b* and 66*c* and flows into the second water switching valves 73*b* and 73*c*, respectively. The water that has flowed into the second water switching valve 73*c* returns to the second water-to-refrigerant heat exchanger 55C.

Note that a control method of the heat exchange capacity of the heat source side heat exchanger 3 is the same as that of Embodiment 1, and its description is omitted.

According to the above-configured air-conditioning apparatus, in addition to the same advantageous effect of Embodiment 1, an advantageous effect in which no refrigerant in the heat source side refrigerant circuit will leak indoors can be obtained. Accordingly, a flammable and/or toxic natural refrigerant or a flammable and/or toxic refrigerant that has high effect in suppressing global warming can be used in the heat source side refrigerant circuit. Thus, an air-conditioning apparatus that can secure both global warming suppressing effect and safety in the indoor space can be obtained. Furthermore, during the switching of the operation modes or during a defrost operation that may temporarily stop the compressor 1, the heating or cooling of the indoor space can be continued although only for a short time since the latent heat of water can be used. Thus, advantageous effect such as increase in comfort can be obtained.

REFERENCE SIGNS LIST

A heat source unit; B, C, D indoor unit; E relay unit; 1 compressor; 2 four-way valve; 3 heat source side heat exchanger; 3*a* to 3*d* solenoid valve; 4 switching valve; 4*a* first check valve; 4*c* third check valve; 4*d* fourth check valve; 5 first branching unit; 6 second branching unit; 7 gas-liquid separator; 8 flow control valve; 9 flow control valve; 10B, 10C, 10D indoor unit side heat exchanger; 11B, 11C, 11D flow control valve; 13B, 13C, 13D solenoid valve; 14B, 14C, 14D solenoid valve; 15A first heat source unit side connecting piping; 15B, 15C, 15D first indoor unit side connecting piping; 16A second heat source unit side connecting piping; 16B, 16C, 16D second indoor unit side connecting piping; 18 air-sending device; 19 condensing temperature detection device; 20 evaporating temperature detection device; 21 first refrigerant circuit; 22 second refrigerant circuit; 23 third refrigerant circuit; 24 first heat exchanger; 25 second heat exchanger; 30 distributor; 40 flow control valve; 50 bypass piping; 51 solenoid valve; 55B first water-to-refrigerant heat exchanger; 55C second water-to-refrigerant heat exchanger; 60 pump; 61B, 61C first water piping; 62B, 62C second water piping; 63B, 63C first water-to-refrigerant heat exchanger connecting piping; 64B, 64C second water-to-refrigerant heat exchanger connecting piping; 65 third water piping; 66 fourth water piping; 68 solenoid valve; 70 indoor side heat exchanger; 71 indoor unit; 72 first water switching valve; 73 second water switching valve; 152 heat exchange capacity regulating device.

The invention claimed is:

1. An air-conditioning apparatus comprising:

a heat source unit comprising:

a heat source side heat exchanger including a plurality of heat exchangers connected in parallel;

a supply device supplying, in a variable manner, an object to be heat exchanged to the heat source side heat exchanger, the object to be heat exchanged exchanges heat with a refrigerant that flows in the heat exchangers;

passage on-off devices opening and closing refrigerant passages of the heat exchangers, respectively;

a bypass piping being connected to the heat exchangers in parallel; and a flow control device being provided in the bypass piping, the flow control device controlling a flow rate of the refrigerant flowing in the bypass piping while some of passages to the plurality of heat exchangers are closed;

a plurality of indoor units, each including an indoor side heat exchanger in which water or antifreeze flows; and a relay unit comprising:

a first and a second water-to-refrigerant heat exchanger where the refrigerant which flows in a refrigerant circuit of the heat source unit exchanges heat with the water or the antifreeze which flows in the indoor units, a flow direction device which controls a flow direction of the refrigerant in the first and the second water-to-refrigerant heat exchangers, and a switching valve which connects the first or the second water-to-refrigerant heat exchanger to the plurality of indoor units, wherein the relay unit and the heat source unit are connected by two refrigerant pipes and the relay unit and each of the indoor unit are connected by two water or antifreeze pipes, and the flow direction device in the relay unit is configured to control both the first and the second water-to-refrigerant heat exchanger to function as an evaporator during a cooling only operation of the plurality of indoor units, control the first and the second water-to-refrigerant heat exchanger to function as a condenser during a heating only operation of the plurality of indoor units, and control one of the first and the second water-to-refrigerant heat exchangers to function as a evaporator and controls the other of the first and the second water-to-refrigerant heat exchangers to function as a condenser during a mixed operation of cooling and heating of the plurality of indoor units.

2. The air-conditioning apparatus of claim 1, further comprising a distributor regulating a gas-to-liquid ratio of a two-phase gas-liquid refrigerant to a prescribed ratio and sending out the two-phase gas-liquid refrigerant to a downstream side of the distributor, the distributor being provided to a junction of pipings connected to the respective heat exchangers of the heat source side heat exchanger and the bypass piping, the junction becoming the inlet side of the heat exchangers of the heat source side heat exchanger when the heat exchangers of the heat source side heat exchanger operate as evaporators.

3. The air-conditioning apparatus of claim 1, further comprising a connecting piping serially connecting at least some of the heat exchangers among the plurality of heat exchangers of the heat source side heat exchanger; and an on-off valve opening and closing a passage of the connecting piping.

4. The air-conditioning apparatus of claim 3, wherein the heat exchangers of the heat source side heat exchanger serially connected by the connecting piping are disposed such that the object to be heat exchanged that has exchanged heat in one of the heat exchangers of the heat source side heat exchanger that is on a downstream side in a refrigerant flow direction is supplied to one of the heat exchangers of the heat source side heat exchanger that is on an upstream side in the refrigerant flow direction.

5. The air-conditioning apparatus of claim 1, wherein the refrigerant flowing in the heat exchangers of the heat source side heat exchanger is a refrigerant that transfers heat to the object to be heat exchanged in a supercritical state without being condensed when transferring heat to the object to be heat exchanged.

6. The air-conditioning apparatus of claim 1, wherein in the mixed operation of cooling and heating of the plurality of indoor units, the first and the second water-to-refrigerant heat exchangers are connected in series with the one of the first and the second water-to-refrigerant heat exchangers that functions as a evaporator being downstream of the other of the first and the second water-to-refrigerant heat exchangers that functions as a condenser.

* * * * *